US010190855B2

(12) United States Patent
Kim et al.

(10) Patent No.: US 10,190,855 B2
(45) Date of Patent: Jan. 29, 2019

(54) BULLET COLLECTING BOX CAPABLE OF STACKING AND INSTALLING, AND BULLET COLLECTING SYSTEM FOR PREVENTING OCCURRENCE OF LEAD FUME IN INDOOR SHOOTING RANGE USING THE BULLET COLLECTING BOX

(71) Applicants: Hee Joung Kim, Chuncheon-si (KR); Min A Kang, Chuncheon-si (KR); Sun Jae Kim, Chuncheon-si (KR); Sun Gu Kim, Chuncheon-si (KR)

(72) Inventors: Hee Joung Kim, Chuncheon-si (KR); Min A Kang, Chuncheon-si (KR); Sun Jae Kim, Chuncheon-si (KR); Sun Gu Kim, Chuncheon-si (KR)

( * ) Notice: Subject to any disclaimer, the term of this patent is extended or adjusted under 35 U.S.C. 154(b) by 107 days.

(21) Appl. No.: 15/163,911

(22) Filed: May 25, 2016

(65) Prior Publication Data

US 2017/0211916 A1 Jul. 27, 2017

(30) Foreign Application Priority Data

Jan. 27, 2016 (KR) ..... 10-2016-0010362

(51) Int. Cl.
*F41J 13/02* (2009.01)
*F41J 11/00* (2009.01)
*F41J 13/00* (2009.01)

(52) U.S. Cl.
CPC ..... *F41J 13/02* (2013.01); *F41J 11/00* (2013.01); *F41J 13/00* (2013.01)

(58) Field of Classification Search
CPC ..... F41J 13/02; F41J 11/00; F41J 13/00
See application file for complete search history.

(56) References Cited

U.S. PATENT DOCUMENTS 4,164,901 A * 8/1979 Everett ..... F41J 11/00 273/410
4,509,301 A * 4/1985 Head ..... E04H 1/125 273/404

(Continued)

FOREIGN PATENT DOCUMENTS

DE 19514660 A1 * 10/1996 ..... B29C 65/56
JP H11-37697 A 2/1999

(Continued)

OTHER PUBLICATIONS

Machine English Translation of DE 19514660 A1 from Espacenet.*

*Primary Examiner* — Gene Kim
*Assistant Examiner* — Jeffrey Vanderveen
(74) *Attorney, Agent, or Firm* — KORUS Patent, LLC; Seong Il Jeong

(57) ABSTRACT

The present invention provides a bullet collecting box which is installed with a plurality of rubber plates in the bullet collecting box having a rectangular parallelepiped shape and filled with rubber powder filling materials having a particle size of 0.1 to 3 mm therein, thereby collecting the bullets fired in the indoor shooting range without damage, and a bullet collecting system which can be used by installing the bullet collecting box in the indoor shooting range. Also, the present invention provides a bullet collecting system for preventing occurrence of lead fume in the indoor shooting range, in which the beaten zone of the indoor shooting range is newly improved from an existing system of using an iron plate to a system of using powder filling materials, thereby preventing the leakage of lead fume, and contributing to an early normalization of the shooting range and a creative national defense.

17 Claims, 30 Drawing Sheets

(56) References Cited

U.S. PATENT DOCUMENTS

| | | | | | |
|---|---|---|---|---|---|
| 5,486,008 | A * | 1/1996 | Coburn | F41J 13/00 | 273/404 |
| 5,655,775 | A * | 8/1997 | Pontus | F41J 13/00 | 273/410 |
| 5,848,794 | A * | 12/1998 | Wojcinski | F41J 13/00 | 273/404 |
| 6,173,956 | B1 | 1/2001 | O'Neal | | |
| 7,967,296 | B1 | 6/2011 | Halverson | | |
| 2013/0201316 | A1* | 8/2013 | Binder | H04L 67/12 | 348/77 |
| 2014/0174284 | A1* | 6/2014 | Peters | F41H 5/24 | 89/36.02 |

FOREIGN PATENT DOCUMENTS

| | | | |
|---|---|---|---|
| JP | 2005-188894 | A | 7/2005 |
| JP | 2009-008316 | | 1/2009 |
| KR | 10-2012-0071200 | A | 7/2012 |
| KR | 10-2013-0066856 | A | 6/2013 |
| KR | 10-2015-0085974 | A | 7/2015 |
| KR | 10-1575273 | B1 | 12/2015 |

* cited by examiner

| Classification | Generation concentration of lead fume | | exposed concentration standard |
|---|---|---|---|
| | lane of fire | beaten zone | |
| 5.56 mm | 0.011 | 0.043 | 0.05 |
| 9.0mm | 0.016 | 0.029 | |

| Classification | Generation concentration of lead fume | |
|---|---|---|
| | lane of fire | beaten zone |
| 5.56 mm | 0.010 | 0.060 |
| 9.0mm | 0.003 | 0.007 |

BULLET COLLECTING BOX CAPABLE OF STACKING AND INSTALLING, AND BULLET COLLECTING SYSTEM FOR PREVENTING OCCURRENCE OF LEAD FUME IN INDOOR SHOOTING RANGE USING THE BULLET COLLECTING BOX

TECHNICAL FIELD

The present invention relates to a bullet collecting box capable of stacking and installing, and a bullet collecting system for preventing occurrence of lead fume in an indoor shooting range by using the bullet collecting box. Particularly, in the case of the existing shooting range in military unit, since a beaten zone was constructed only by an iron plate, there were problems that bullets are broken while colliding with the iron plate, and heavy metal components such as lead or copper contained in the bullets are spread in the air, causing a large damage due to environmental contamination. Therefore, in order to solve these problems, the present invention provides a bullet collecting box that can collect the bullets without damage using a filling material in the form of a powder, thereby preventing scatteration of the heavy metal components such as lead or copper contained in the bullets, and collecting and recycling the bullets, and a bullet collecting system for preventing occurrence of lead fume in the indoor shooting range using the bullet collecting box.

BACKGROUND OF ART

In order to train a skillful use of a gun in the military unit and the police, it is essential to install and operate the indoor shooting range. However, recently, it became known to everybody that as bullets collides with the iron plate in the beaten zone, the heavy metal components such as lead or copper contained in the bullets are flying and scattered as they are, which may contaminate an air and cause damage to the surrounding environment. It reached up to a situation where the operation of the indoor shooting range in the military unit and the police is stopped.

The existing indoor shooting range is configured such that a beaten zone accepting bullet is constructed only by an iron plate. Therefore, when the bullets fired from the gun collide with the iron plate, a sound is very large and the bullets are broken to pieces and crushed, which made it impossible to collect the bullets. During breakage or crumbling of bullets in this way, the bullets are scattered into very small particle components and thus the heavy metal components such as lead or copper contained in the bullets are flown and scattered as they are, which cause a heavy metal pollution to people such as the soldier and police who perform a firing exercise in the shooting range and thus it is likely to damage their health. Moreover, the environment surrounding the indoor shooting range has been subjected to a large damage due to the heavy metal pollution. In addition, the heavy metal components such as lead or copper contained in the bullets are, on the other hand, valuable resources, but these resources cannot be recycled at all. Therefore, there has been very unfavorable drawbacks even in the economic aspects of the operation of the defense and police budgets that are fully taxed.

For solving the above-mentioned problems and for the earliest normal operation of the indoor shooting range installed in the military unit and the police training center, there remains a need to develop a bullet collecting system with a new concept which can collect the bullets without damage and prevent the heavy metal pollution in the air caused by the breakage or crushing of bullets.

DETAILED DESCRIPTION OF THE INVENTION

Technical Problem

In order to achieve the above-mentioned problems of the prior arts, the present invention provides a bullet collecting box which is installed with a plurality of rubber plates in the bullet collecting box having a rectangular parallelepiped shape and filled with rubber powder filling materials having a particle size of 0.1 to 3 mm therein, thereby collecting the bullets fired in the indoor shooting range without damage, and a bullet collecting system which can be utilized by installing the bullet collecting box in the indoor shooting range.

Also, the present invention provides a bullet collecting system for preventing occurrence of lead fume in the indoor shooting range, in which the beaten zone of the indoor shooting range is newly improved from an existing system of using an iron plate to a system of using powder filling materials, thereby preventing the leakage of lead fume, and contributing to an early normalization of the shooting range and a creative national defense.

Further, the present invention provides a bullet collecting system for preventing occurrence of lead fume in the indoor shooting range, in which the bullets can be collected by stacking the bullet collecting boxes having box shapes to the beaten zone of the indoor shooting range as many number of plates as required in the height direction and thereby, the bullets can be safely collected by the rubber powder filling materials without damage; the bullets can be collected in a stable manner; and the valuable resources contained in the bullets, i.e., copper and lead, can be recycled.

In addition, in order to prevent outbreak of fire during collection of bullets in the powder filling materials of the bullet collecting box, the present invention provides a bullet collecting system which is installed with a spray pipe capable of discharging water to the bullet collecting unit of the indoor shooting range, but which is configured such that water discharged through a spray pipe can be continuously recycled to the the water for fire prevention, thereby establishing "waste water-free discharge system" configured such that the water used in the indoor shooting range is not discharged as a waste water to the outside.

Meanwhile, the present invention provides a bullet collecting system for preventing occurrence of lead fume in the indoor shooting range which is configured such that, using a waste warship where the use term was expired and discarded in the army, the indoor shooting range is constructed in the inside of the waste warship, thereby applying to a waste warship such as a battleship.

Technical Solution

In order to achieve the above objects, the present invention provides a bullet collecting box capable of stacking and installing, characterized in that the bullet collecting box includes: a frame 20 configured by combining a square pipe made of a metal material in a rectangular parallelepiped form; a main body 1*a* forming a space therein by combining a plated iron plate on the remaining surfaces excluding the front portion and the upper portion of the frame 20; a front bracket 40 formed to be protruded at a first thickness in the front portion of the body (1*a*) and having a rubber plate insertion groove 40*a* extending in the vertical direction; a front rubber plate 4 which can be inserted and separated in a sliding manner in a rubber plate insertion groove 40*a* of the front bracket 40; a first inner rubber plate 6 installed uprightly in the inner space of the body 1*a* and positioned in the rear side of the front rubber plate 4; a second inner rubber plate 6 installed in the rear side of the first inner rubber plate 6 in the inner space of the body 1*a* and spaced apart at a second interval from the first inner rubber plate 6; a bullet collecting space 131 present between the first inner rubber plate 6 and the second inner rubber plate 7; an upper lid (3) which covers the opening portion formed on the upper surface of the body 1*a*; a first rubber plate support 6*a* which is formed to be protruded on the inside surface of both side surfaces 2 of the body 1*a* and configured such that the first inner rubber plate 6 can be combined and separated in a sliding manner to the inside surface of the side plates 2 of the body 1*a*; a second rubber plate support 7*a* which is formed to be protruded, respectively, on the inside surface of the both side plates 2 of the body 1*a* and configured such that the second inner rubber plate 7 can be combined and separated in a sliding manner to the inside surface of the side plates of the body 1*a*; powder filling materials 9 having a particle size of 0.1-3 mm which are filled within the bullet collecting space 131 in the inside of the body 1*a*; a bottom opening 52 formed on the bottom plate 51 of the body 1*a*; and a bottom lid plate 53 which can be combined and separated in a sliding manner to the bottom plate 51 and which can block the bottom opening 52 when combined with the bottom plate 51.

Also, in order to achieve the above objects, the present invention also provides a bullet collecting box capable of stacking and installing, characterized in that the powder filling materials 9 includes one or more materials selected from the group consisting of a rubber, a synthetic rubber, a natural rubber, a pulverized material of waste tire, a carbon black, a silica, and a silicon rubber material.

Further, in order to achieve the above objects, the present invention further provides a bullet collecting box capable of stacking and installing, characterized in that the bullet collecting box further includes: a support leg 5 which is combined and installed to the bottom plate 51 of the body 1*a*, wherein the support leg 5 includes a square pipe 5*a* arranged in the parallel direction to the the longitudinal direction of the body 1*a*, a rubber block 5*c* which is disposed in front of the square pipe 5*a* and made of a rubber material, thereby absorbing an impact due to the bullets, and a magnet 5*b* interposed between the square pipe 5*a* and the rubber block 5*c*.

Meanwhile, in order to achieve the above objects, the present invention provides a bullet collecting system for preventing occurrence of lead fume in the indoor shooting range, characterized in that the bullet collecting system includes: a gun firing position 106*a* which fires bullets 8 from a gun 7 using a bullet in the indoor shooting range 101; a target which is spaced apart by a third distance from the gun firing position 106*a*; and a bullet collecting unit which is located in the rear side of the target and which collects bullets 8 which are fired by the gun 7 and flying, wherein the bullet collecting unit includes a plurality of bullet collecting boxes 1, and the bullet collecting boxes 1 include: a frame 20 configured by combining a metal material-made square pipe in a rectangular parallelepiped form; a main body 1*a* forming a space therein by combining a plated iron plate on the remaining surfaces excluding the front portion and the upper portion of the frame 20; a front bracket 40 formed to be protruded at a first thickness in the front portion of the body (1*a*) and having a rubber plate insertion groove 40*a* extending in the vertical direction; a front rubber plate 4 which can be inserted and separated in a sliding manner in a rubber plate insertion groove 40*a* of the front bracket 40; a first inner rubber plate 6 installed uprightly in the inner space of the body 1*a* and positioned in the rear side of the front rubber plate 4; a second inner rubber plate 6 installed in the rear side of the first inner rubber plate 6 in the inner space of the body 1*a* and spaced apart at a second interval from the first inner rubber plate 6; a bullet collecting space 131 present between the first inner rubber plate 6 and the second inner rubber plate 7; an upper lid 3 which covers the opening portion formed on the upper surface of the body 1*a*; a first rubber plate support 6*a* which is formed to be protruded on the inside surface of both side surfaces 2 of the body 1*a* and configured such that the first inner rubber plate 6 can be combined and separated in a sliding manner to the inside surface of the side plates 2 of the body 1*a*; a second rubber plate support 7*a* which is formed to be protruded, respectively, on the inside surface of the both side plates 2 of the body 1*a* and configured such that the second inner rubber plate 7 can be combined and separated in a sliding manner to the inside surface of the side plates of the body 1*a*; powder filling materials 9 having a particle size of 0.1-3 mm which are filled within the bullet collecting space 131 in the inside of the body 1*a*; a bottom opening 52 formed on the bottom plate 51 of the body 1*a*; and a bottom lid plate 53 which can be combined and separated in a sliding manner to the bottom plate 51 and which can block the bottom opening 52 when combined with the bottom plate 51.

Further, in order to achieve the above objects, the present invention provides a bullet collecting system for preventing occurrence of lead fume in the indoor shooting range, characterized in that the bullet collecting unit further includes a spray pipe 116 installed at the upper end of the stacked and installed bullet collecting boxes 1; a protective case 117 which is extended along the longitudinal direction of the spray pipe 116 and wraps around the spray pipe 116 and thus protects so that the spray pipe 116 is not broken by the bullets 8 fired by the gun 7; and at least one fire detecting sensor 108 which is installed in the space of 1 m or less from the inside or the surrounding of the bullet collecting box 1; and further includes a water supply pipe 503 of supplying water to the spray pipe 116; an electric valve 504 which is installed on the water supply pipe 503 and which serves to send or not send water by being open or closed by an electrical signal; a control unit which is electrically connected with the fire detecting sensor 108 and the electric valve 504, and detects occurrence of a fire within a bullet collecting portion by a signal transmitted from the fire detecting sensor; a drainage trench 105 installed by digging grooves in the bottom surface in front of the bullet collecting unit; a water collection tank 500 for collecting water discharged through the drainage trench 105; and a water pump 501 which is installed inside the water collection tank 500 and sends water in the water collection tank 500 to a water supply pipe 503.

Advantageous Effects

Since the bullet collecting box according to the present invention has a rectangular parallelepiped shape, it is possible to stack as many numbers of plates as required in the height direction and it is easy to install the bullet collecting box without major structure changes in the existing indoor shooting range. And also, the bullet collecting box of the present invention is easy to separate and collect powder filling materials and thus management costs required for post-processing can be reduced.

The bullet collecting system for preventing occurrence of lead fume in the indoor shooting range according to the present invention can fully block heavy metal materials such as lead or copper contained in the bullets from polluting the air due to the breakage and scattering of bullets in the indoor shooting area. Therefore, it can obtain a large effect on environmental protection and resource recycling around the indoor shooting range.

Further, according to the present invention, the bullets can be safely collected without damage by the bullet collecting structure using a powder filling material and a rubber plate and thus it can fundamentally block the occurrence of lead fume which may be caused while lead components in the bullets are scattered into smoke. As a result, the present invention allows an early normalization of the indoor shooting range in the military unit and the police that the operation are restricted due to the current problems of environmental pollution, thereby contributing to a creative national defense and a security maintenance.

Further, the apparatus of the present invention has powder filling materials, including a rubber powder or the like, the bullets can be safely collected without damage by the powder filling materials. Therefore, the bullets can be collected in a stable manner; and the valuable resources contained in bullets, i.e., copper and lead, can be recycled.

In addition, since the apparatus of the present invention has the fire detecting sensor and the spray system for fire protection, even if a fire is generated by the friction of bullets and powder filling materials, it is possible to suppress fires at an early stage. Therefore, there is an advantage that the indoor shooting range can be safely operated. Further, since the water used for fire suppression can be continuously recycled without being discharged to the outside, there is an advantage that it contributes to environmental protection and water saving.

DETAILED DESCRIPTION OF THE EMBODIMENTS

Below, the configuration and operational effect of the bullet collecting box capable of stacking and installing according to the present invention and of the bullet collecting system for preventing occurrence of lead fume in the indoor shooting range using the bullet collecting boxes will be described in detail.

Figure 1:
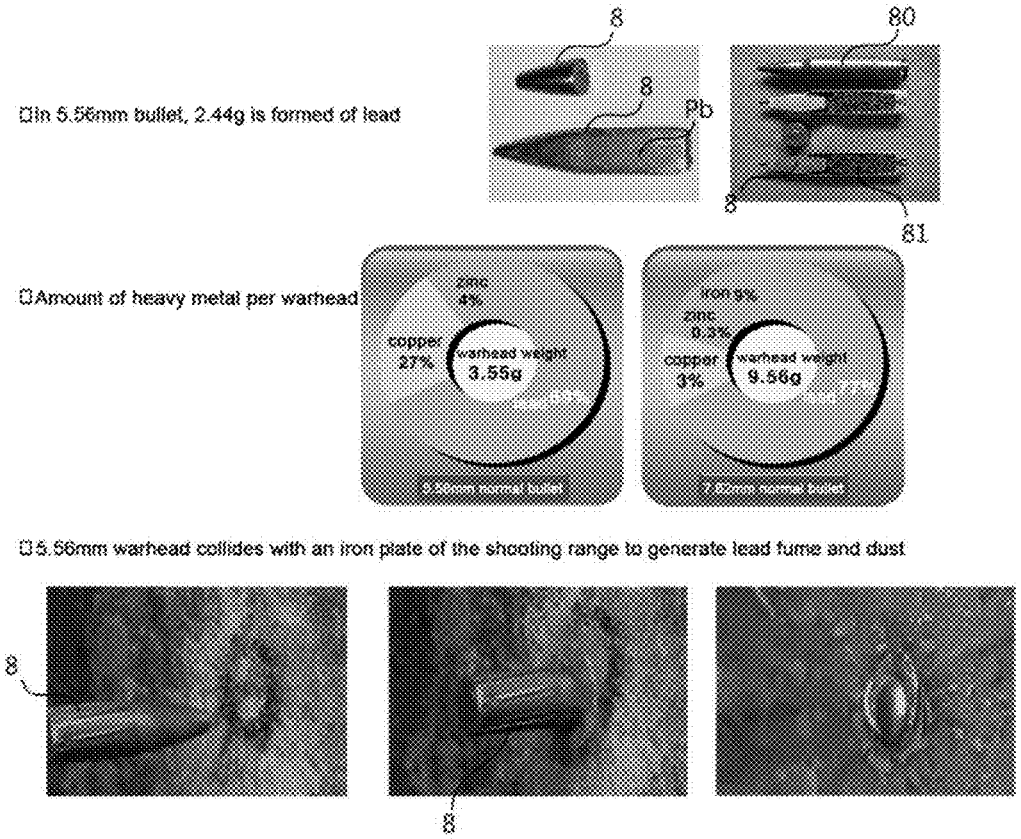
FIG. 1 illustrates the cause of lead contamination in a conventional indoor shooting range, and shows a scene where the bullet fired by a gun collides with an iron plate of the shooting range to generate lead fumes and dusts.

FIG. 1 illustrates the cause of lead contamination in a conventional indoor shooting range, especially the lower part of FIG. 1 shows a scene where the bullets fired by a gun collide with an iron plate of the shooting range to generate a lead fume and a dust.

Referring to FIG. 1, the bullet 8 of 5.56 mm×45 mm bullet 80 used as a standard bullet of the military unit contains about 2.44 g of lead (Pb). The small image at the top right side of FIG. 1 shows an example in which the bullet 8 is located in the front part of bullets 8 and the remaining space of bullets 80 is filled with ammunition 81.

In the pictures located in the middle stage of FIG. 1, the amount of the heavy metal components contained in 5.56 mm normal bullet and 7.62 mm normal bullet are displayed in a pie chart format. In the case of 5.56 mm normal bullet, the weight of a bullet is 3.55 g, among which 69% is filled with lead. Also, in the case of 7.62 mm normal bullet, the weight of a bullet is 9.56 g, among which 77% is filled with lead.

The small image in the first lower part of FIG. 1 shows a scene where the bullets 8 collide with an iron plate of the beaten zone installed in the shooting range to generate a lead fume and a dust. In the case of a conventional indoor shooting range, the bullets collide with the iron plate in this way to become a powder, and the fine powders are scattered into the air, thus causing severe air pollution problems.

On the other hand, the ammunition used in small arms which are individual weapons used in the military unit and the police has a caliber of 30 mm (0.6 inches) or less. The small arms ammunition includes, for example, handgun ammunition (caliber: 9 mm, 22 mm), small arms ammunition (caliber: 5.56 mm, 7.62 mm), machine gun ammunition (caliber: 5.56 mm, 7.62 mm) and the like. The general structure of small arms ammunition is shown in FIG. 2.

Figure 2:
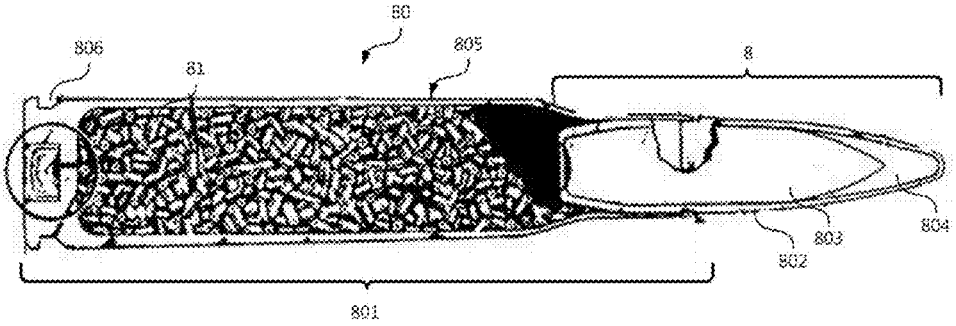
FIG. 2 is a cross-sectional structural view of the bullet 80.

Referring to FIG. 2, a bullet (ammunition, 80) consists of a carriage portion 801 that largely puts a gunpowder and provides a firing energy to the bullet 8 by the explosive force, and a bullet 8 combined to a front surface of the carriage portion 801. The carriage portion 801 consists of a a carriage case 805, also referred to as casing, and a propellant gunpowder 81 embedded in the carriage case 805, and an extracted groove 806 is formed at the lower part of the carriage case 805. And the bullet 8 is also referred to as a shot and is composed of a jacket 802 corresponding to a shell, a core 803 therein, and a bullet filling material (incendiary) 804 for filling a space therebetween.

The jacket 802 is composed of nickel, brass (copper+zinc alloy), and the bullet filling material 804 is composed of antimony (Sb) and lead (Pb). Among them, although varied for each bullet based on the total weight of the bullet 8, lead accounts for approximately 69-85% by weights of the entire bullet 8. Copper accounts for 14-27% by weight of the entire bullet. Zinc accounts for 0.7-4% by weight of the entire bullet. Antimony used in a trace amount during preparation of bullets is responsible for the role of increasing the strength, preventing chemical corrosion and lowering the melting point of the alloys, and it contains on average within the range of 1.5%.

Figure 3:
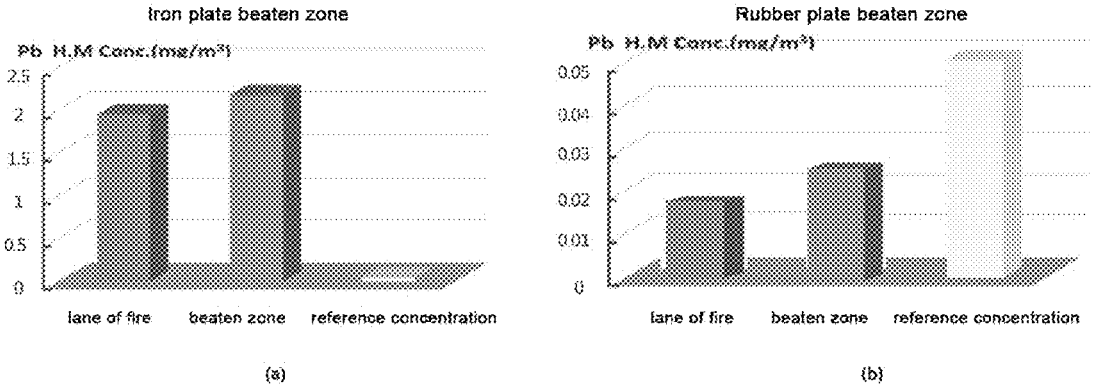
FIG. 3 graphically shows a comparison of the detection results of the lead concentration in a conventional indoor shooting range having a beaten zone made of iron plate and in the indoor shooting range having a bullet collecting unit according to the present invention.

FIG. 3 graphically shows a comparison of the detection results of the lead concentration in a conventional indoor shooting range having a beaten zone made of iron plate and in the indoor shooting range having a bullet collecting unit according to the present invention. Among them, FIG. 3(*a*) is a graph illustrating the lead concentration detected from a lane of fire and a conventional iron plate in the existing indoor shooting range having a conventional beaten zone made of iron plate. FIG. 3(*b*) is a graph illustrating the lead concentration detected from a lane of fire and a beaten zone in the indoor shooting range according to the present invention.

Referring to FIG. 3, the reference value of the lead detection concentration set for the indoor shooting range is 0.05 mg/m$^3$. In the case of a conventional indoor shooting range, the lead concentration in the lane of fire which fires a gun was detected to be 2 mg/m$^3$ or more and the lead concentration in the beaten zone was detected to be approximately 2.4 mg/m$^3$. Thus, it has been found that the detection concentration is about 1000 times higher than the reference value of 0.05 mg/m$^3$. On the other hand, in the case of the indoor shooting range to which the bullet collecting system for preventing occurrence of lead fume according to the present invention is applied as described later, as a result of using rubber powder filling materials to the beaten zone, the lead concentration in the lane of fire has been found to be approximately 0.018 mg/m$^3$, and the lead concentration in the beaten zone has been found to be approximately 0.026 mg/m$^3$, which showed that the degree of contamination is much lower than the reference value of 0.05 mg/m$^3$ (see FIG. 3(*b*)).

Figure 4:
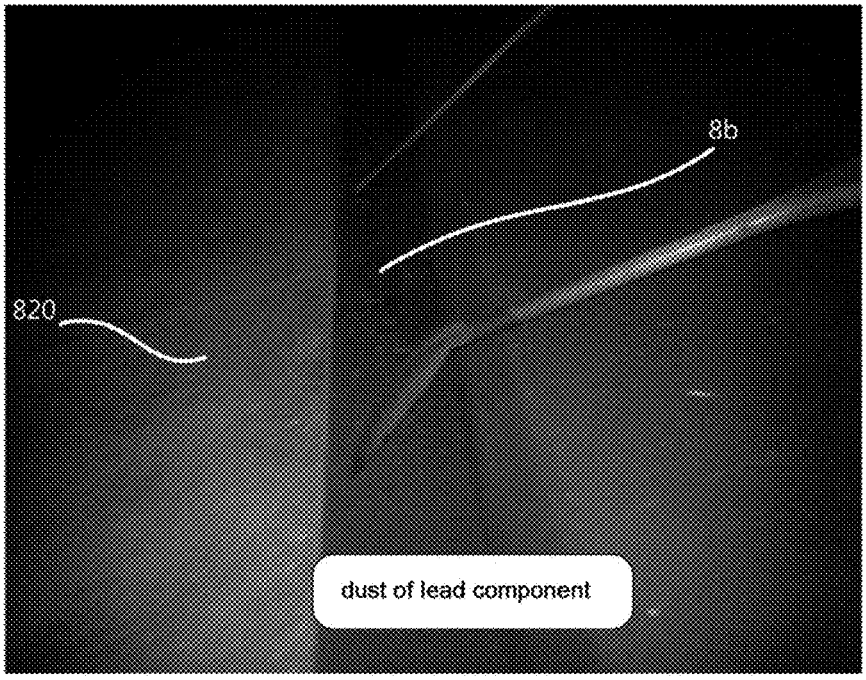
FIGS. 4 and 5 are photographs of a dust 8*b* and a lead component debris 8*a* in the beaten zone 820 of the indoor shooting range having a conventional beaten zone made of iron plate.
Figure 5:
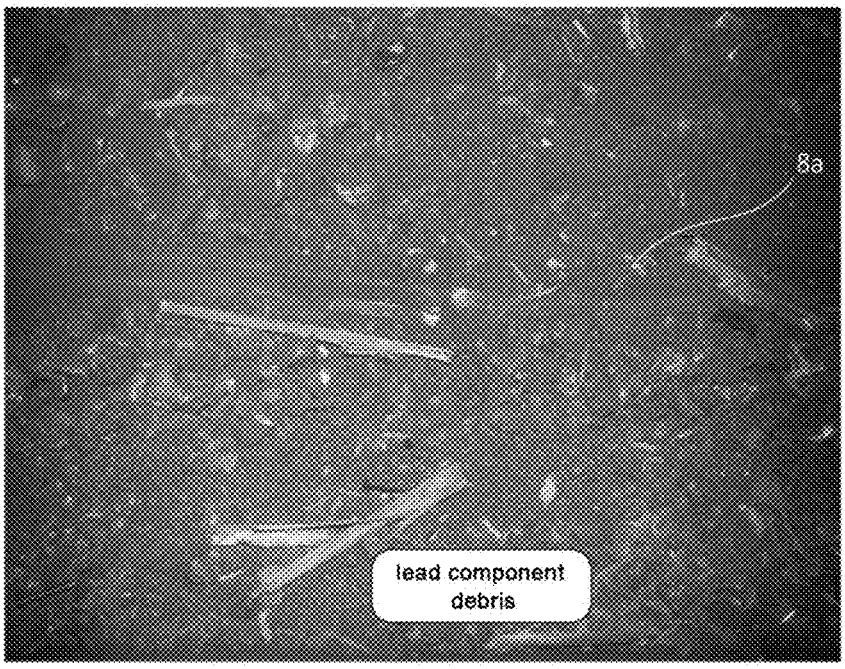

FIGS. 4 and 5 are photographs of a dust 8*b* and a lead component debris 8*a* in the beaten zone 820 of the indoor shooting range having a conventional beaten zone made of iron plate.

First, referring to FIG. 4, it can be seen that, after completing the shooting, the large amount of dust as it can sweep into a shovel was stacked up in the bottom of the beaten zone. The amount of dust at the bottom of the beaten zone made of iron plate is 235 g/m$^3$, and the lead concentration in the dust is 31.3 g/kg, which shows that the contamination due to lead is very high. The number of this pollution concentration is about 1,000 times higher than the standard of measures of soil pollution, and there is an urgent need to make a countermeasure against this. Further, FIG. 5 is a photograph obtained by photographing the lead component debris 8*a* that can be seen at the bottom of the iron plate beaten zone installed in a conventional indoor shooting range.

Figure 6:
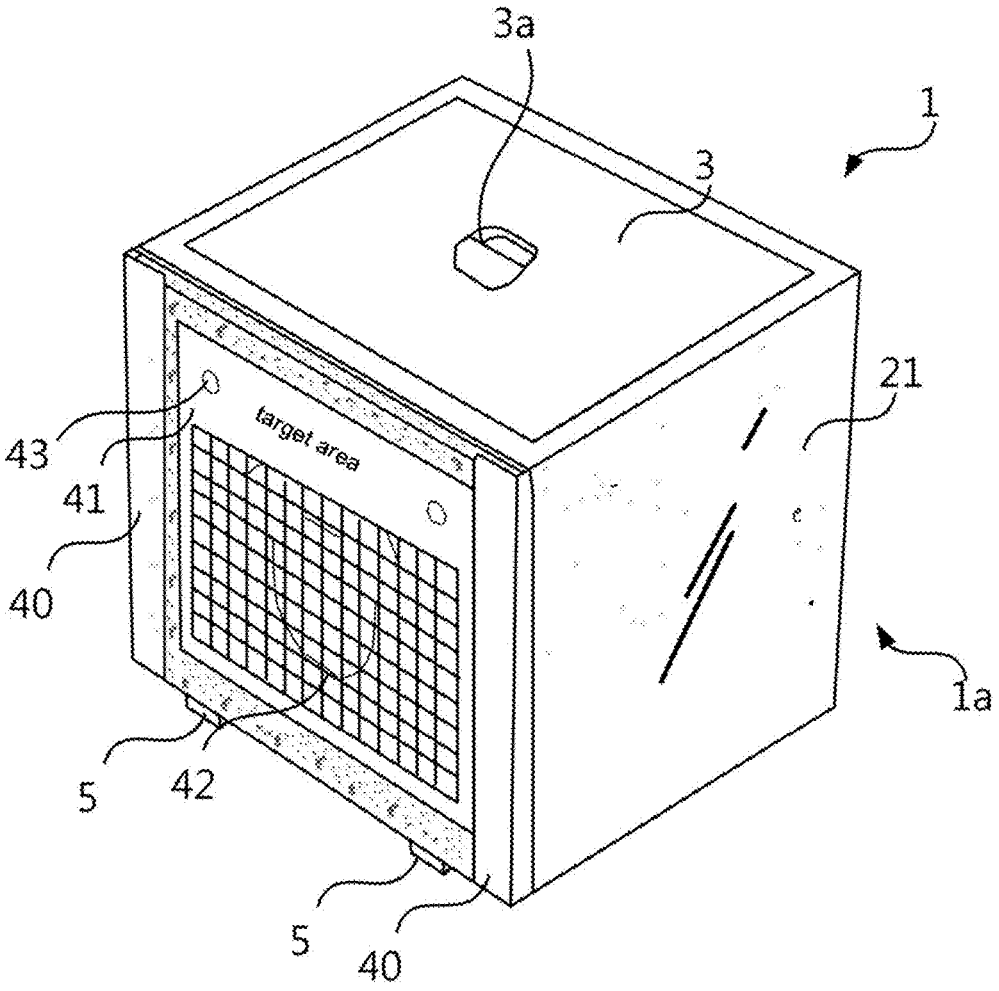
FIG. 6 is a perspective view of the bullet collecting box 1 capable of stacking and installing according to the present invention.

FIG. 6 is a perspective view of the bullet collecting box 1 capable of stacking and installing according to the present invention. Referring to FIG. 6, the bullet collecting box 1 has an outer shape like as a rectangular parallelepiped-shaped box, and it is formed of a structure in which the upper lid 3 is covered on the upper opening of the body 1*a* which has a space therein. The front rubber plate 4 to which the target area 41 is attached is located in the front side of the main body 1*a*, and the front rubber plate 4 can be inserted and embedded in a sliding manner to a front bracket 40 installed to be fixed to the body 1*a*. Images of the target 42 are shown in the target area 41, and the target area 41 is combined to the front rubber plate 4 by means such as an attachment pin 43.

Meanwhile, a support leg (5) is installed in the bottom plate 51 (see FIG. 9) of the body 1*a* and thus the bullet collecting box 1 can be placed on the ground. Further, when a plurality of the bullet collecting box 1 is stacked in a vertical direction, the support leg 5 can be placed in the portion of the upper lid 3 of the bullet collecting box 1 located in the lower portion, which facilitates stacking the bullet collecting boxes in a vertical direction.

In FIG. 6, the reference numeral 2 refers to a side plate 2 of the body 1*a*, and the side plate 2 is configured such that the metal-made square pipes 23 (see FIG. 8) form a framework, and a plated steel plate 21 is surrounded on the outside.

In this case, as the plated steel plate 21, galvalume is preferably used. The galvalume is a plated steel plate made of a mixture of aluminum and zinc and has advantages that it is resistant to corrosion, smooth to the plated surface and provides the appearance of white metal, which looks beautiful. Further, as a framework in the inside of the body 1*a*, square pipes (23) constituting a frame 20 (see FIG. 8) can be manufactured by a metal material such as iron, aluminum, or other alloys, particularly it is preferably manufactured by a galvanized steel material. The front bracket 40 is installed to project and bend in an L-shape in the front portion of the body 1*a* and it is preferably manufactured by iron or galvalume material.

Figure 7:
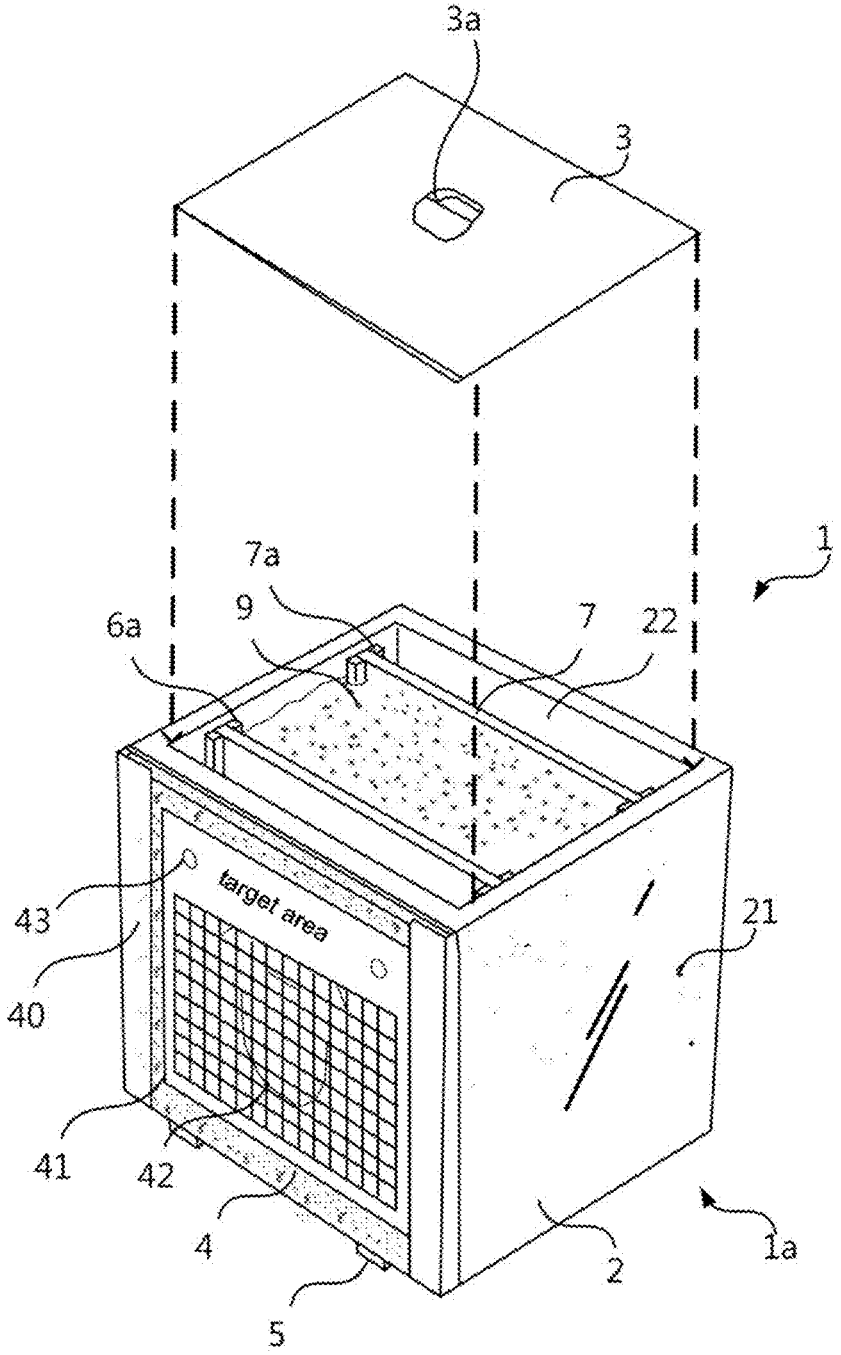
FIG. 7 is a perspective view showing a part of the internal structure of the bullet collecting box 1 in which the upper lid 3*a* of the bullet collecting box 1 shown in FIG. 6 is separated.

Meanwhile, since the upper lid 3 shown in FIG. 6 is formed with a handle 3*a*, a person can hold a handle 3*a* to lift up the upper lid 3 (see FIG. 7).

FIG. 7 is a perspective view showing a part of the internal structure of the bullet collecting box 1 in which the upper lid 3*a* of the bullet collecting box 1 shown in FIG. 6 is separated.

Referring to FIG. 7, in the inside of the body 1 of the bullet collecting box 1, two rubber plates, i.e., the first inner rubber plate 6 and the second inner rubber plate 7 are installed uprightly in a parallel direction to the front rubber plate 4. The first inner rubber plate 6 can be inserted between the gaps of the first rubber plate supports 6*a* provided inside the side plates 2 to insert and separate in a sliding manner. The second inner rubber plate 7 can also likewise be inserted between the gaps of the second rubber plate support 7*a* provided inside the side plates 2 to insert and separate in a sliding manner.

The space existing between the first inner rubber plate 6 and the second inner rubber plate 7 is a bullet collecting space 131 (see FIG. 8) capable of collecting bullets which have penetrated through the front rubber plate 4 of the bullet collecting boxes 1 and become flying. The bullet collecting space 131 is filled with powder filling materials 9 with a fine particle size. The powder filling material 9 has a particle size of 0.1-3 mm and is preferably manufactured by including one or more materials selected from the group consisting of a rubber, a synthetic rubber, a pulverized material of waste tires, a carbon black, a silica and a silicon rubber material. Since the powder filling material 9 is in the form of a powder with a fine particle size, it can sufficiently absorb the impact energy of the bullet when the bullet 8 has penetrated through the bullet collecting box 1 and become flying, and it can stop the bullet 8 without damage and collect it.

Meanwhile, in FIG. 7, the powder filling material 9 is filled only in the bullet collecting space 131 positioned between the first inner rubber plate 6 and the second inner rubber plate 7. Like this, only the inside space of the bullet collecting space 131 may be filled with the powder filling materials 9, or the entire inside space of the body 1*a* of the bullet collecting box 1 may be filled with the powder filling materials 9. In the case of filling the powder filling materials 9 in the entire inside space of the body 1*a* of the bullet collecting box 1 in this way, the amount of the powder filling materials 9 is increased and thus there is a disadvantage that the more time and effort are required for the replacement work, but it is more effective to absorb the impact energy of the bullet 9. Therefore, it would be advantageous to collect the bullet fired by large guns having high firing force.

Figure 8:
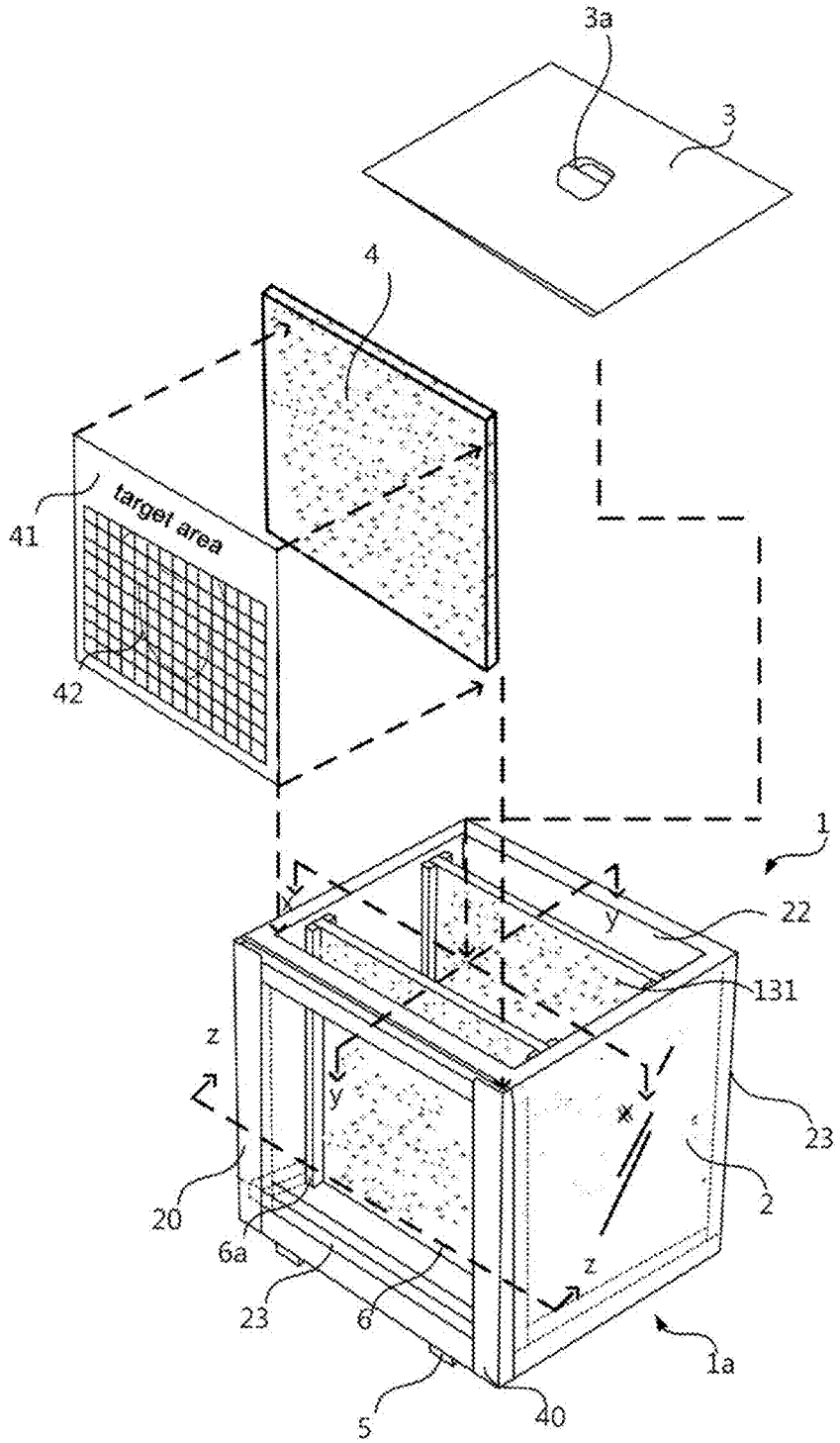
FIGS. 8 and 9 are an exploded perspective view of the bullet collecting box 1 shown in FIGS. 6 and 7.
Figure 9:
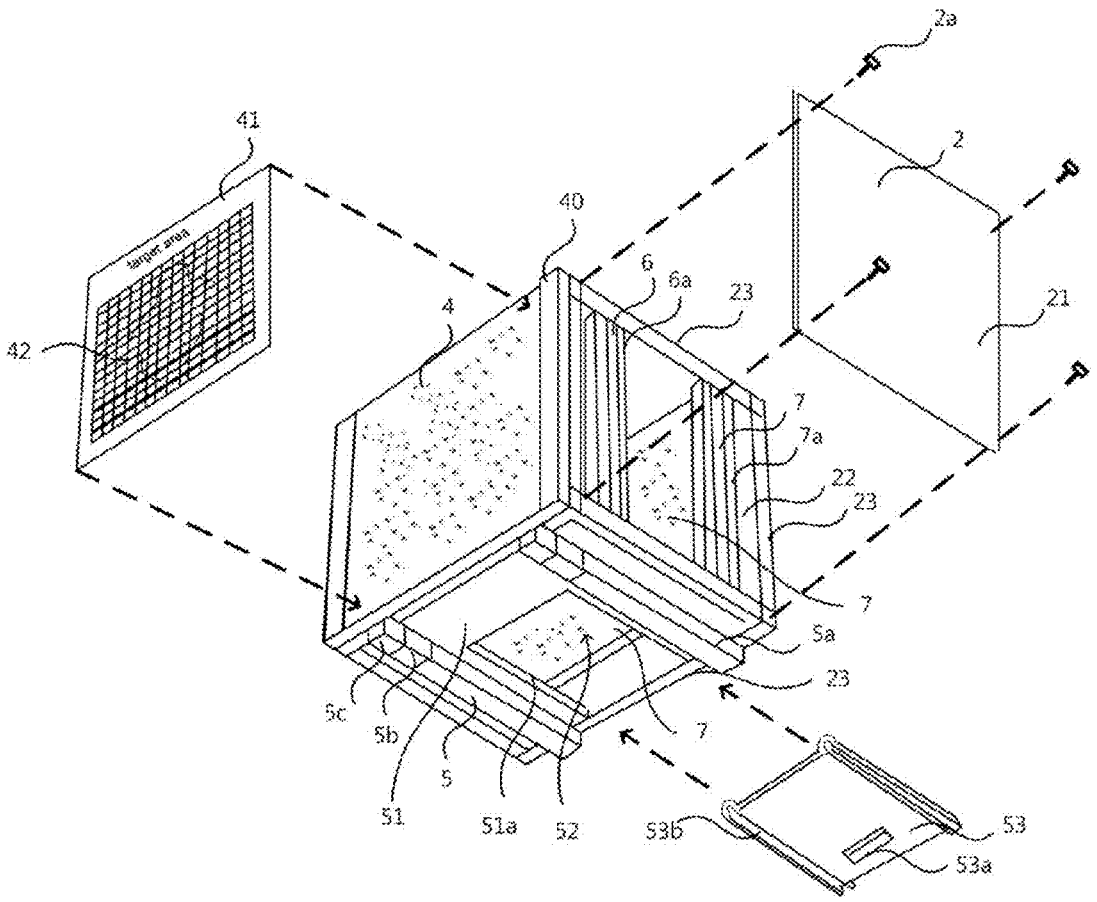

FIGS. 8 and 9 are an exploded perspective view of the bullet collecting box 1 shown in FIGS. 6 and 7.

First, FIG. 8 is an exploded perspective view of showing the internal structure of the bullet collecting box 1 in which the components of the bullet collecting box 1 are separated at an angle as in FIG. 6. It can be seen that the body 1*a* of the bullet collecting box 1 is configured such that the plated steel plates 21, 22 are combined inside and outside on the frame in which the framework is fabricated with square pipes 23.

The side plate 21 and the back plate of the body 1*a* are configured such that the plated steel plates 21, 22 are combined inside and outside the frame 20 in which the framework is fabricated with square pipes 23. The bottom plate 53 (FIG. 9) is preferred to combine only the plated steel plate to the outside of the frame 20.

The front bracket 40 installed on the front part of the body 1*a* is bent into L-shape and has a rubber plate insertion groove 40*a* between the square pipes 23 constituting the frame 20 of the body 1*a*, and the front rubber plate 4 can be inserted in a sliding manner by the rubber plate insertion groove 40*a*, and the used front rubber plate 4 can be again pulled out and separated.

In the inner surface of the side plates 2 of the body 1*a*, the first rubber plate support 6*a* and the second rubber plate support 7*a* are installed in pairs, respectively. The first inner rubber plate 6 and the second inner rubber plate 7 can be inserted in a sliding manner along a groove provided between the first and second rubber plate supports 6*a*, 7*a*. In this case, the first rubber plate support 6*a* and the second rubber plate support 7*a* are preferably manufactured by using the square pipe. In particular, it is preferable to use the square pipe with galvanized surface.

FIG. 9 is an exploded perspective view of the bullet collecting box 1 at an angle looking up diagonally from the bottom. It shows that the bottom opening 52 is formed on the bottom plate 51 of the bullet collecting box 1, and the bottom stopper plate 53 is combined detachably to the bottom plate 51.

The bottom opening 52 formed at the bottom plate 51 of the body 1*a* of the bullet collecting box 1 serves as a passage for discharging powder filling materials 9 contained in the bullet collecting box 1, and the bottom stopper plate 53 can be combined with the bottom plate 51. Both edges of the bottom opening 52 of the bottom plate 51 is formed of a protruding jaw 51*a*, and both edges of the bottom stopper plate 53 are formed of a sliding groove 53*b*. Therefore, the bottom stopper plate 53 can be combined or separated with the bottom plate 51 by a sliding combination between the sliding groove 53*b* and the projecting jaw 51*a*. Meanwhile, since a handle 53*a* is formed at the bottom stopper plate 53, it is possible to easily perform the work in which a person holds a handle 53*a* and insert or withdraw the bottom stopper plate 53 in the bottom plate 51.

The bottom surface of the bullet collecting box 1 is installed with a support leg 5, and the support leg is formed as a structure in which the square pipes 5*a*, the rubber block 5*c* and magnet 5*b* are connected in series. The square pipes are respectively installed to be spaced apart in the left and right sides along the front-rear direction of the bullet collecting box 1 and can be manufactured with metal materials such as iron, aluminum, or metal alloys. In particular, it is preferable to manufacture with galvanized iron. The square pipes 5*a* can be combined to the bottom plate 51 using means such as a volt, or it can be combined directly by a welding method. A magnet 5*b* is combined in front of the square pipes 5*a*. When stacking and installing the bullet collecting boxes, the magnet 5*b* serves to pull with the body of another bullet collecting box located at the bottom and stick well to each other. Further, the rubber block 5*c* is positioned in front of the magnet 5*b*. The rubber block 5*c* serves to protect the back-sided magnet 5*b* and square pipes 5*a* from the bullets.

Meanwhile, FIG. 9 illustrates that the plated steel plate 21 forming the side plate 2 is combined with the square pipes 23 of the frame 20 by means such as a volt 2*a*. Alternatively, it is possible to combine the plated steel plate 21 itself by welding directly to the square pipe 23.

Figure 10:
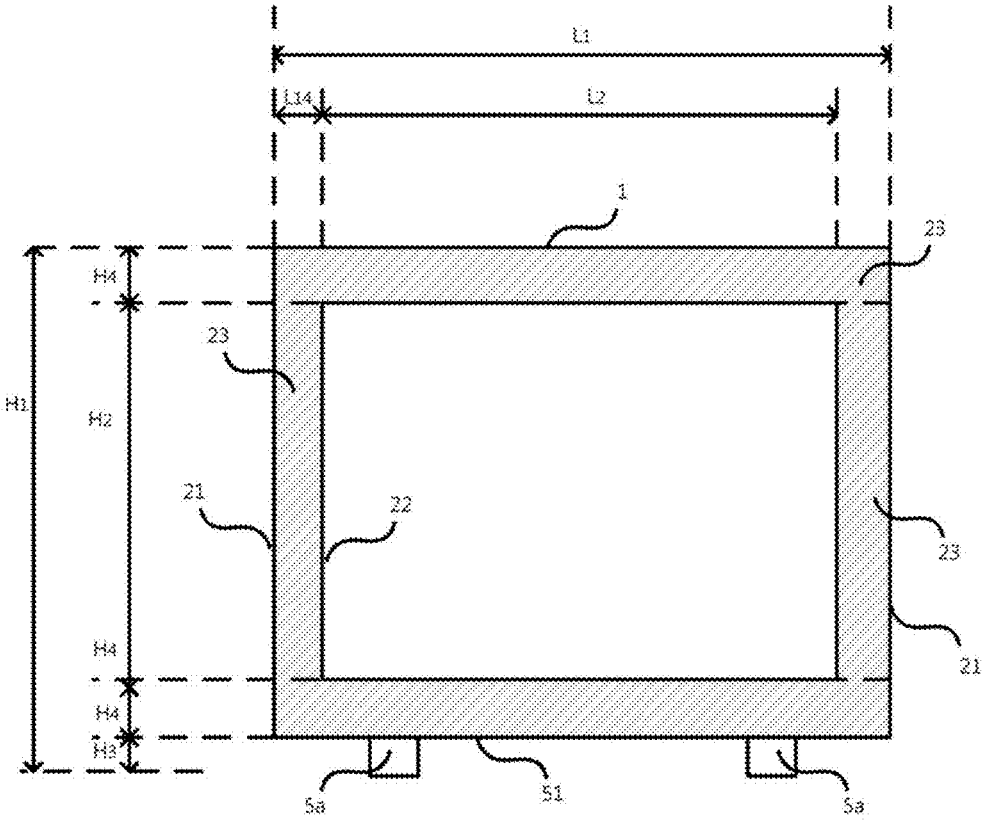
FIG. 10 is a cross-sectional view of the bullet collecting box 1 taken along the line X-X in FIG. 8.

FIG. 10 is a cross-sectional view of the bullet collecting box 1 taken along the line X-X in FIG. 8, and shows that another square pipe 5*a* constituting the support leg is combined to the bottom of the frame fabricated by the square pipes 23. In FIG. 10, the reference numeral H1 refers to the entire height of the body 1*a* of the bullet collecting box 1, H2 refers to the thickness or height of the square pipes 5*a* constituting the supporting leg 5*a*, and H4 refers to the thickness or height of the square pipes 23 constituting the frame 2. H2 refers to the remaining height excluding the heights H3 and H4 in the entire height H1 of the body 1*a*, and L1 refers to the left and right width of the bullet collecting box 1, and L14 refers to the width of the square pipe 23 constituting the frame 2. L2 refers to the remaining width excluding the widths 23 of both side square pipes 23 in the entire width L1 of the bullet collecting box 1.

Figure 11:
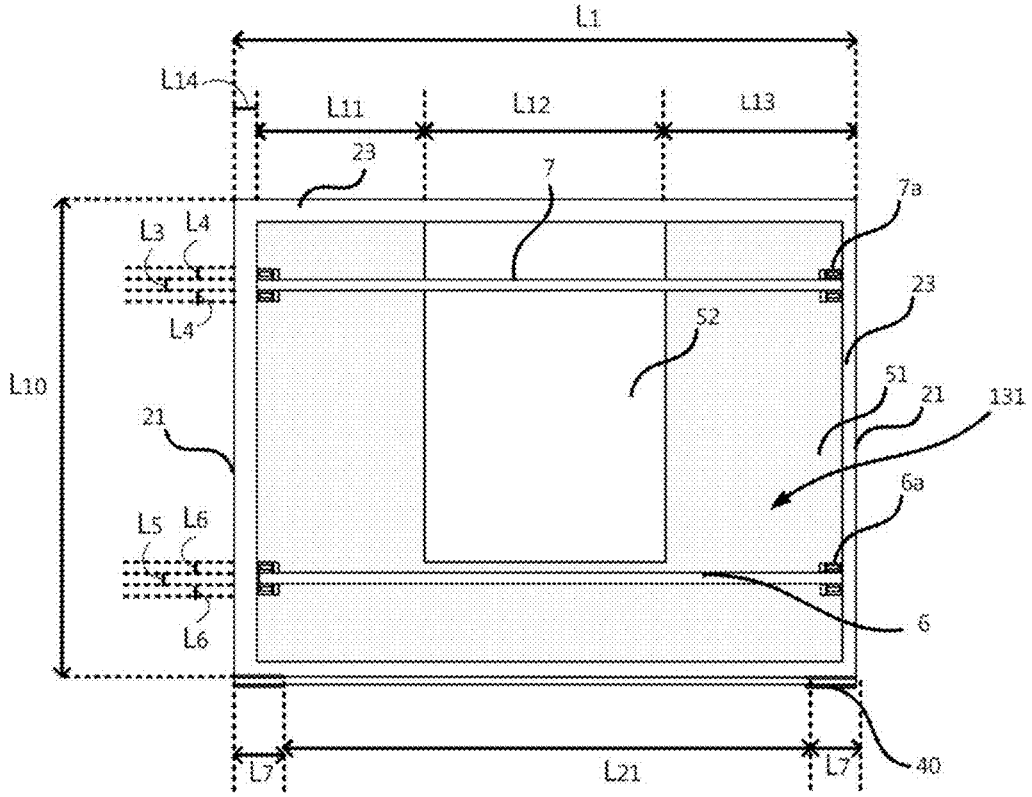
FIG. 11 is a cross-sectional view of the bullet collecting box 1 taken along the line Y-Y in FIG. 8.

FIG. 11 is a cross-sectional view of the bullet collecting box 1 taken along the line Y-Y in FIG. 8. Referring to FIG. 11, the reference numeral L10 refers to the length in the front-rear direction of the body 1*a*. The front bracket 40 provided on the front side of the body 1*a* has a "t"-shaped rubber plate insertion groove 40*a*, and the interval of the rubber plate insertion grooves 40*a* is t1. In this case, the reference numeral L7 refers to a width of the front bracket 40, and L21 refers to the remaining width excluding both widths L7 of the front bracket 40 in the entire width L1 of the bullet collecting box.

Further, the first rubber plate support 6*a* and the second rubber plate support 7*a* can be fabricated by using the square pipes, and for example, a galvanized pipe where a size of the cross-sectional shape is 25 mm×40 mm can be used. In this case, in FIG. 11, the width (L6, L4) of the front-rear direction of the first rubber plate support 6*a* and the second rubber plate support 7*a* is 25 mm. The intervals (L5, L3) of the respective grooves produced by the first rubber plate support 6*a* and the second rubber plate support 7*a* is preferably identical with or slightly larger than the thickness of the first and second inner rubber plates 6,7.

FIG. 11 illustrates that the bottom opening 52 is formed on the bottom plate 51. The bottom opening 52 has a width of L12, and the remaining widths excluding the width L12 of the bottom opening 52 in the bottom plate 51 are L11 and L13, respectively.

Figure 12:
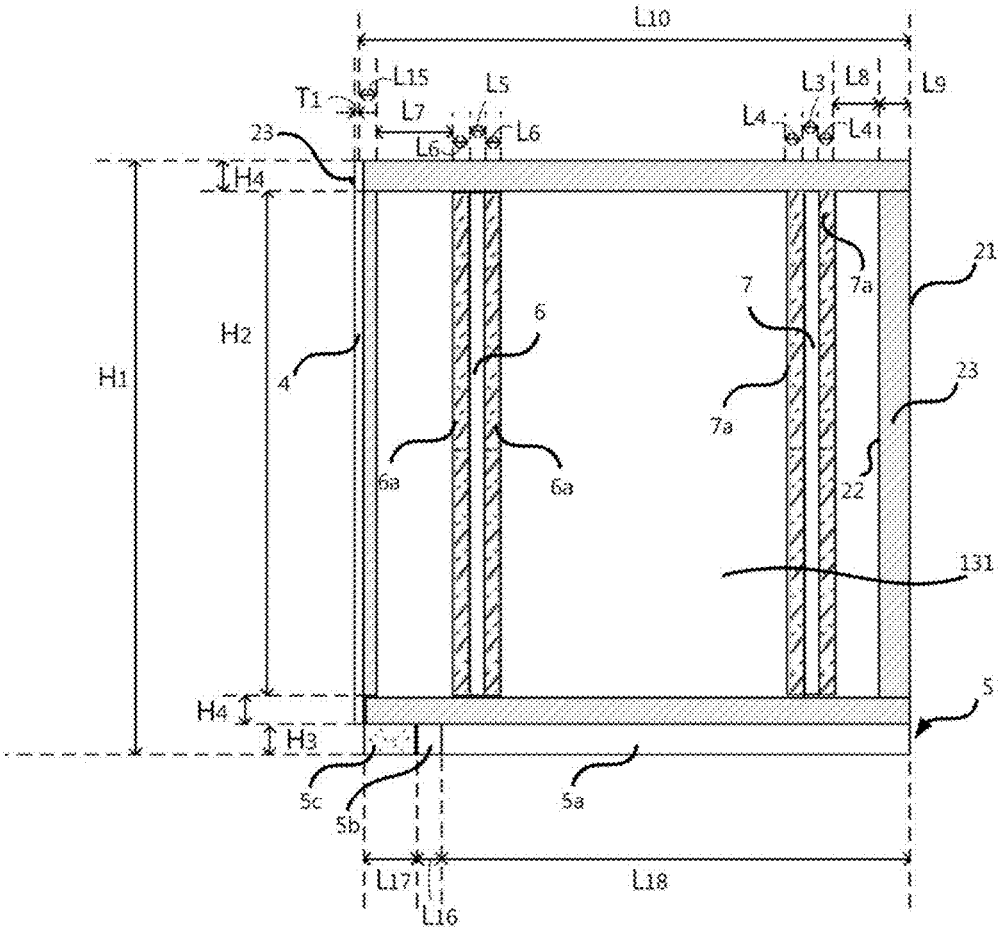
FIG. 12 is a cross-sectional view of the bullet collecting box 1 taken along the line Z-Z in FIG. 8.

FIG. 12 is a cross-sectional view of the bullet collecting box 1 taken along the line Z-Z in FIG. 8. In FIG. 12, the reference numerals L15 and L9 are the thickness of the square pipes 23 located in the front and back sides of the body 1*a*, L7 is a distance between the first rubber plate support 6*a* and the square pipe of the front portion, and L19 is a distance between the first rubber plate support 6*a* and the second rubber plate support 7*a*. L8 is a distance between the second rubber plate support 7*a* and the square pipe 23 in the back side of the body 1*a*. Meanwhile, the length of the square pipe 5*a* combined with the lower surface of the bottom plate 51 is L18, the length of the magnet 5*b* combined in front thereof is L16, and the length of the rubber block 5*c* located at the head is L17.

Referring to FIG. 10 to FIG. 12, the length L10 in a back and forth direction of the body 1*a* of the bullet collecting box 1 is 0.8-1.2 m, the width L1 in the right and left direction of the body 1*a* is 1-1.5 m, and the height H1 of the body 1*a* is 0.9-1.3 m. In the case of the square pipes 23 constituting the frame 20, it is preferable that the length of one side (H14, L14, L15, H4, L9) in the cross-sectional shape is 30-60 mm, and the thickness of the metal material is 2-10 mm. Further, the thickness of the plated steel plates 21,22 is preferably 1-1.5 mm, and the thickness of the front rubber plate 4, the first inner rubber plate 6 and the second inner rubber plate 7 is preferably 12-25 mm.

The separation distance between the front rubber plate 4 and the first inner rubber plate 6 is preferably set to 0.14-0.25 m, and the separation distance between the first inner rubber plate 6 and the second inner rubber plate 7 is preferably 0.5-0.7 m.

Furthermore, according to the experiment of the present inventors, the length L10 in the back and forth direction of the body 1*a* of the bullet collecting box 1 is 1 m, the width L1 in the right and left direction of the body 1*a* is 1.3 m, and the height (H1) of the body 1*a* is 1.1 m. The cross-sectional shape of the square pipes 23 constituting the frame 20 is preferably 40 mm×40 mm. When the thickness of the first inner rubber plate 6 and the second inner rubber plate 7 is 15 mm, the separation distance between the front rubber plate 4 and the first inner rubber plate 6 is 0.19-0.21 m and the separation distance between the first inner rubber plate 6 and the second inner rubber plate 7 is 0.6-0.65 m, it is possible to obtain the result of exhibiting the best bullet collecting efficiency.

Figure 13:
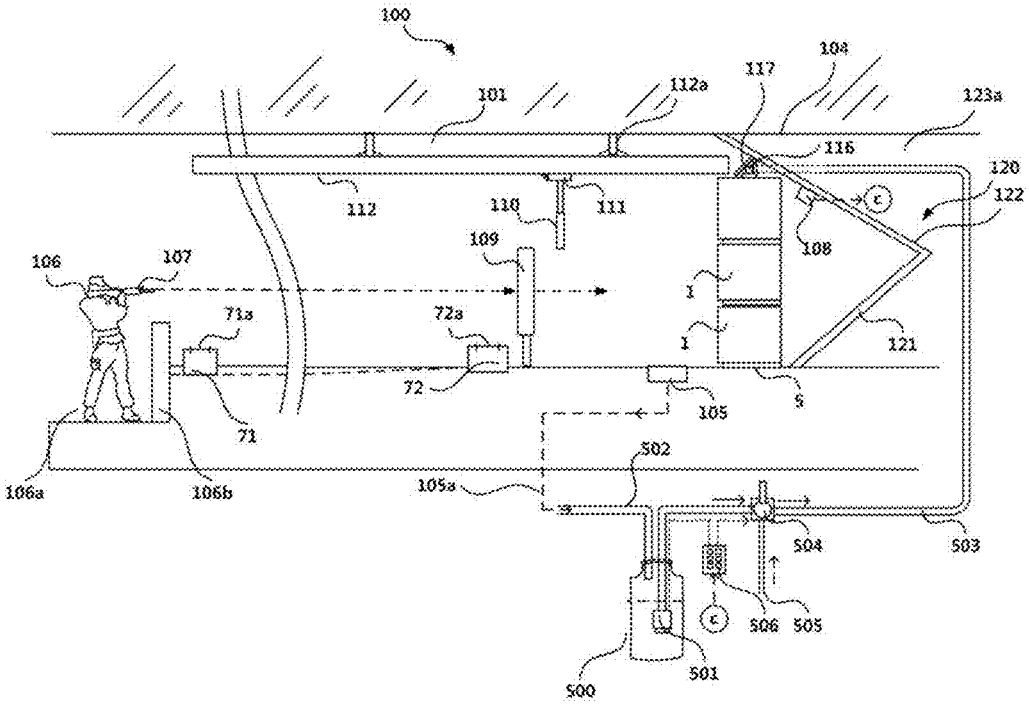
FIG. 13 shows an overall configuration of a bullet collecting system 100 for preventing occurrence of lead fume in the indoor shooting range according to the present invention.

FIG. 13 is an overall configuration of a bullet collecting system 100 for preventing the occurrence of lead fume in the indoor shooting range according to the present invention.

Referring to FIG. 13, the firing position 106*a* is provided at one side end of the indoor shooting range 101, and the bullet collecting unit 130 is provided on its opposite side. At the firing position 106*a*, a gunner 106 is capable of firing the firearm 107, and the bullet 8 flown from the firing position 106*a* goes through the target plate 109, penetrates into the bullet collecting boxes 1 of the bullet collecting unit 130 and then stops. Since the powder filling materials 9 consisting of small grains, such as rubber powders, are filled within the bullet collecting space 131 (FIG. 8) of the bullet collecting boxes 1, the bullet 8 goes through the front rubber plate 4 (FIG. 6 to FIG. 8) of the bullet collecting box 1 and penetrates into the bullet collecting space 131 and then collides with the powder filling materials 9. Thereby, the kinetic energy is dissipated and the bullet is safely stopped as it is, without cracking.

Since the conventional indoor shooting ranges which are operated by the military unit and the police training center have used an iron plate beaten zone 120, in order to more easily apply the bullet collecting unit 130 of the bullet collecting system according to the present invention to the conventional indoor shooting ranges, it is preferable to utilize the iron plate beaten zone 120 equipments rather than removing the existing iron plate beaten zone, and further incorporate and install the bullet collecting unit 130. That is, as shown in FIG. 13, the conventional indoor shooting ranges 101 are configured such that the iron plate beaten zone 120 consisting of the conventional upper iron plate 122 and the conventional lower iron plate 121 are present on the opposite end of the firing position 106*a*. However, while these conventional iron plate beaten zones 120 are left as they are, it is advantageous to additionally install the bullet collecting unit 130 using the bullet collecting box 1 of the present invention on its front.

For the conventional iron plate beaten zone 120, the conventional upper iron plate 122 and the conventional lower iron plate 121 have been installed in a state of being spread like a shape of ">" in order for the bullet 8 to collide with the iron plate and then not bounce off to the outside. That is, the conventional upper iron plate 122 has been configured such that the front end is connected to a ceiling. It has been installed in an inclined state so that the height is gradually increased toward the rear side of the indoor shooting range. Also, the conventional lower iron plate 121 has been configured such that the front end is fixed to the bottom surface 102 of the indoor shooting range 101. It has been installed in an inclined state so that the height is gradually increased toward the rear of the indoor shooting range. Consequently, the conventional upper iron plate 122 and the conventional lower iron plate 121 have been spread in a shape of ">", just like opening the mouth, toward the firing position 106*a*, and the rear end of the iron plates 122, 121 are met and combined with each other at the rear end.

In the present invention, the bullet collecting unit 3 is constructed of a stacked structure by stacking the bullet collecting boxes 1 in a vertical direction. Such a stacked structure of the bullet collecting boxes is spread in a horizontal direction (in a lateral direction) and installed like a kind of wall (see FIGS. 15 and 16).

As the powder filling materials 9 which are filled in the bullet collecting box 1, materials such as rubber powders with a particle size of 0.1-3 mm can be used. In this case, even if the particle size of the filling materials is reduced, the bullet is not damaged during the collision and penetration of the bullet and thus, the collecting efficiency of the bullet can be increased. According to the experiment of the present inventors, when the used filling materials such as the rubber powders have the particle size of 1.5 mm or less, the collecting efficiency of the bullet exceeds 93%, thereby achieving excellent collecting efficiency of the bullet. The materials of the powder filling material 9 that can be used here include one or more materials selected from the group consisting of a rubber, a rubber, a synthetic rubber, a natural rubber, a pulverized material of waste tires, a carbon black, a silica and a silicon rubber material.

On the other hand, it is possible to mix and use the powder fire-extinguishing agent components within the powder filling materials 9. When the powder fire-extinguishing agent is included in the powder filler 9 and filled in the bullet collecting box 1, there is an effect of quickly suppressing the fire by the fire protection function of the powder fire-extinguishing agent components even if the fire is generated due to the friction heat of the bullets 8 and the filling material 9. At this time, the weight of the powder fire-extinguishing agent mixed within the powder filling material 9 is preferably 2-10% of the total weight of the powder filling material 9.

Referring to FIG. 13, the upper end of the bullet collecting unit 130 is installed with a spray pipe 116 capable of spraying water, and the circumference of the spray pipe 116 is installed to a metal protective case 117 along the longitudinal direction, thereby preventing the spray pipe from being damaged due to impact with the bullet 8. On the other hand, the bottom plate of the protective case 117 is formed with a large number of holes and thus water discharged from the spray pipe 116 can be poured out towards the bullet collecting box 1.

In the spray pipe 116, water is supplied by the water supply pipe 503. If the fire or smoke is detected by the fire detecting sensor 108, the control unit 506 operates an electric valve 504 and a water pump 501 to supply water to the water supply pipe 503.

On the other hand, the water discharged from the spray pipe 116 is drained to the outside of the indoor shooting zone 101 via the drainage trench 105 formed immediately in front of the bullet collecting unit 130. The water thus discharged flows and gathers into the water collecting tank 50 through a drainage pipe 105*a* and a water inlet pipe 502. The water collecting tank 500 may be installed under the ground in the space of the indoor shooting range 101 or it may be installed adjacent to the outside of the building of the shooting range. In order to enable a natural drain flow of water, it is preferable that the water collecting tank 500 is buried in the ground.

The water flown through the drainage trench 105 is gathered inside the water collecting tank 500. The water pump 501 is installed in the water, and water can be supplied to the water supply pipe 503 by the operation of the pump 501. The electric valve 504 is installed in the line of the water supply pipe 503, and contributes to the work where the water in the water collecting tank 500 is supplied or water is supplied from a separate water pipe and then sends to the water supply pipe 503. Therefore, the electric valve preferably takes the form of a three-way valve so that it can selectively bring to take the water in the water collection tank and the water in the water tank and send to the water supply pipe 503. The control unit 506 is electrically connected to the fire detecting sensor 60. When it detects that the fire or smoke has occurred in the bullet collecting space 130, the water pump 501 and the electric valve 504 are operated to discharge water through a spray pipe 116.

At the moment of firing the gun 107, the ammunition of bullet burns to occur a gunpowder smoke, and even at the moment that the bullet penetrates into the rubber plates 4,6 of the bullet collecting boxes 1, the dust is generated. Therefore, if the gunpowder smoke and the dusts are left as they are, the air in the indoor shooting range is contaminated. This is not good for the health of people who participate in firing exercise. In order to solve such a problem, the bullet collecting system 100 according to the present invention further includes an air conditioning system capable of sucking up the air near the firing position 100 and in front of the bullet collecting unit 130 to forcibly discharge the air. That is, according to the present invention, the first air suction duct 71 is installed in a bottom surface 102 close to a blocking wall 106*b* of the firing position 106*a*, and the second air suction duct 72 is installed in a floor surface close to the target plate 9. The first air suction duct 71 and the second air suction duct 72 are long-extended along the width direction of the indoor shooting range (see FIG. 19). The upper surface of the air suction ducts 71, 72 are provided with a plurality of air suction ports 71*a*, 72*a* along its longitudinal direction. Therefore, the air contaminated inside the indoor shooting range 2 are forcibly discharged to the outside through the first and second air suction ducts 71, 72 immediately.

In FIG. 13, two types of targets are illustrated together for convenience of explanation. That is, the target plate 109 in the form of being erected on the bottom surface 102 is shown, and the target 110 capable of automatically moving along the guide rail 112 installed in a ceiling 104 is also shown. The target moving system 111 capable of installing a target 110 mounted in the air can be moved by combining wheel 111*b* (FIG. 14) with the guide rail 112. The guide rail 112 is fixedly installed by connecting a mounting rod 112*a* to the ceiling 112.

On the other hand, the bottom surface of the indoor shooting range 101 is preferably formed by a slope gradient surface 103 having a inclined angle of 1-5° so that the water can be naturally drained until the firing position 106*a* and the drainage trench 105.

In FIG. 13, the reference numeral 123*a* refers to a first empty space that exists between the conventional upper and lower steel plates 122, 121 and the rear wall of the steel plate beaten zone 120, and the reference numeral 123*b* refers to a second empty space that exists between the conventional upper and lower steel plates 122, 121 and the bullet collecting unit 130.

Figure 14:
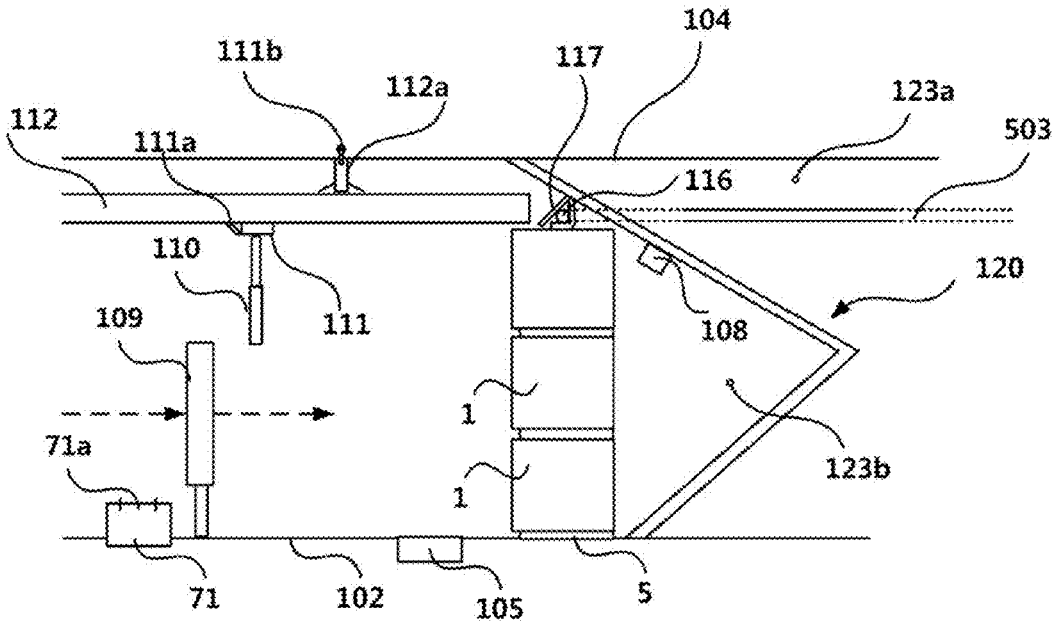
FIG. 14 is an enlarged view of a part of the bullet collecting unit 130 in the bullet collecting system 100 shown in FIG. 13.

FIG. 14 is an enlarged view of a part of the bullet collecting unit 130 in the bullet collecting system shown in FIG. 13. The reference numeral 111*a* displays a number of lanes of fire in the front side of the target moving system 111, and the bottom end of the target moving system 11 is installed with a target 110.

In the present invention, it is preferable to use the rubber plate for conveyor belt having a thickness of 10 mm-25 mm which is mainly used as the front rubber plate 4 and the inner rubber plates 6,7 of the bullet collecting box 1. Such rubber plate for conveyor belt includes a fiber therein. Thus, only a small bullet hole is merely formed on the surface of the rubber plate during shooting and the rubber plate itself is not broken.

Further, in order to experimentally confirm the durability of the front rubber plate 4 and the inner rubber plates 6,7 used in the present invention, it is preferable to first discharge about 100 to 200 bullets and then check the status of holes appeared on the front rubber plate 4 and the inner rubber plates 6,7. The bullet flown into the bullet collecting box 1 is stopped within the bullet collecting unit between the first inner rubber plate 6 and the second inner rubber plate 7. Therefore, in practice, the bullet does not collide with the second rubber plate 7, and it is normal that the damage of the second rubber plate 7 is not appeared. As a result of checking the status of the front rubber plate 4 and the first inner rubber plate 6, it could be confirmed that when using a soft rubber plate as compared with the standard, small holes are swelled up on the rubber plates, just like toad's shell.

Figure 15:
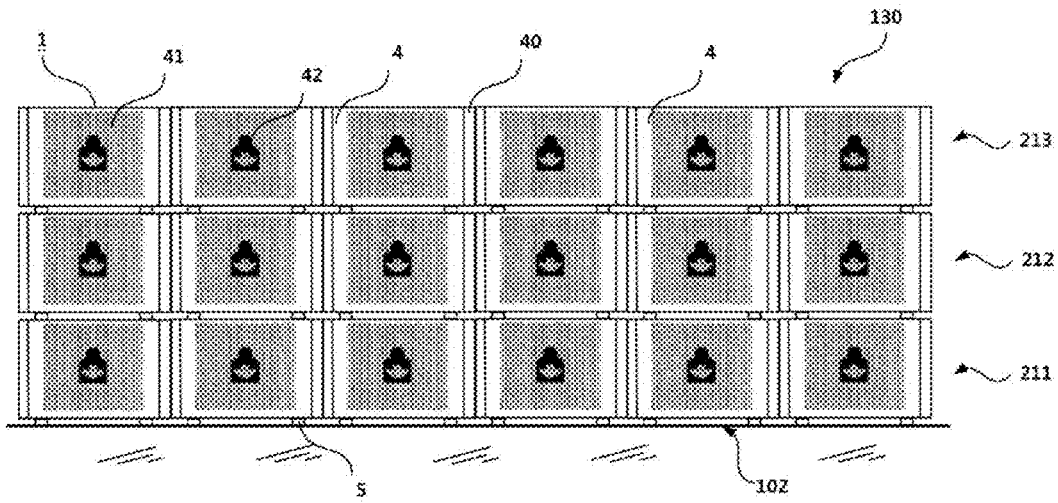
FIG. 15 is a configuration example of the bullet collecting unit 130 in which the bullet collecting box 1 shown in FIG. 6 is stacked in a vertical direction and installed by a plurality of columns in a horizontal direction.

FIG. 15 is a configuration example of the bullet collecting unit 130 in which the bullet collecting box 1 shown in FIG. 6 is laminated in a vertical direction and installed by a plurality of columns in a horizontal direction. The bullet collecting box 1 of the present invention is fabricated in a box shape of a rectangular parallelepiped. Thus, the bottom and upper surfaces are flat and thus it is easy to continually stack up in a height direction. The bullet collecting boxes 1 thus stacked up can maintain a sense of stability. In particular, since a part of the support leg installed at the bottom of the bullet collecting box 1 is formed with a magnet 5*b*, it can expect an action of pulling by the magnetic force with the body 1*a* and the top surface in the bullet collecting box 1 made of an iron material. Therefore, the work of stacking up the bullet collecting boxes 1 in a vertical direction can be easily carried out.

Figure 16:
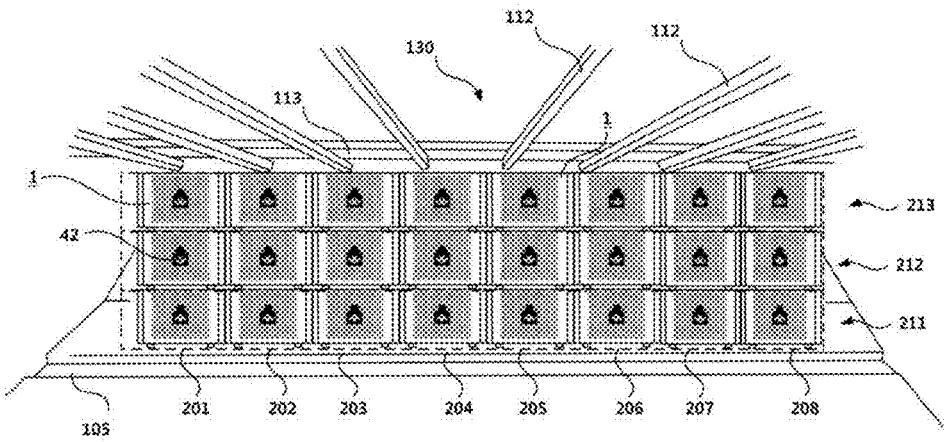
FIG. 16 shows a picture obtained by viewing the bullet collecting unit 130 in FIG. 16 from the front.

FIG. 16 shows a picture obtained by viewing the bullet collecting unit 130 shown in FIG. 13 from the front. As shown in FIG. 16, the entire area of the beaten zone is divided into eight lanes of fire (201, 202, 203, . . . , 208) in the width direction by each of the bullet collecting boxes 1 stacked up like a vertical wall, and it is also divided into three beaten zones 211, 212, 213 from the first stage to the third stage in the height direction. The arrangement structure of the area of the beaten zone shown in FIG. 16 is presented for exemplary purposes only. Therefore, in the actual indoor shooting range, the number of the lanes of fire can be increased or decreased, and the number of stages in the height direction is not necessarily limited to three, but it can be further increased or decreased to four, five or the like.

When eight lanes of fire are provided in the indoor shooting range as shown in FIG. 16, it is preferred that two lanes 201, 208 located at the most edge are utilized as preliminary lanes of fire and they are not utilized as normal lanes of fire. In this case, the area where the firing is mainly made in one lane of fire will be, for example, an area corresponding to the two-stage height, and the area (beaten area) of the two-stage height portion in one lane of fire becomes an area of the front surface of the bullet collecting box.

On the other hand, since the bullet collecting unit 130 is divided into a plurality of the bullet collecting boxes 1, it enables the bullet to get truck in a certain bullet collecting box while positioning the target plate for each bullet collecting box, thereby managing the collection zone of bullets.

For example, practically, the bullets will be mainly positioned at the bullet collecting boxes with two-step height and thus the bullets get intensively stuck in the bullet collecting boxes at that position. In a state where the bullets get intensively stuck in the two-step beaten zone 212, when performing the work of replacing the powder filling materials 9 of the bullet collecting boxes for the purpose of collecting bullets later, there is no need to replace the powder filling material 9 of the entire bullet collecting boxes 1 at the same time. For example, it is sufficient to replace only the powder filling materials 9 of the bullet collecting boxes belonging to the two-step beaten zone.

According to the experiments of the present inventors, in the case of using the rubber plate material for conveyor belt as the front rubber plate 4 and setting the thickness of the rubber plate 4 to 15-20 mm, when 20,640 bullets were discharged per one lane of fire, the necessity to replace the rubber plate 4 has occurred. Therefore, it was judged that there is no need to replace the front rubber plate 4 and the powder filling material 9 until the bullets of 20,000 bullets per one lane of fire get stuck in the boxes. When reflecting such a degree of shooting amount to the current operation status of the indoor shooting range of the military unit, it could be confirmed that it is sufficient that the work to replace the front rubber plate 4 and the powder filling material 9 of the main fire impact point is performed in a cycle of about once every 6 months.

Figure 17:
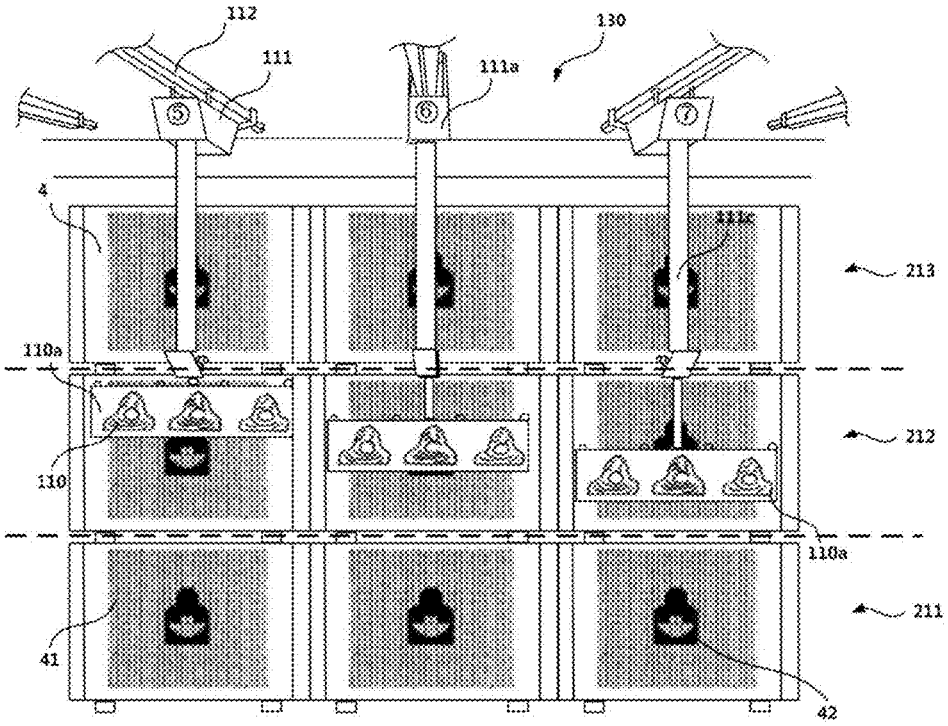
FIG. 17 shows a state where a position-movable target plate 110*a* is disposed by a target moving unit 111 in front of the bullet collecting boxes 1 of the bullet collecting system 130 in FIG. 16.
Figure 18:
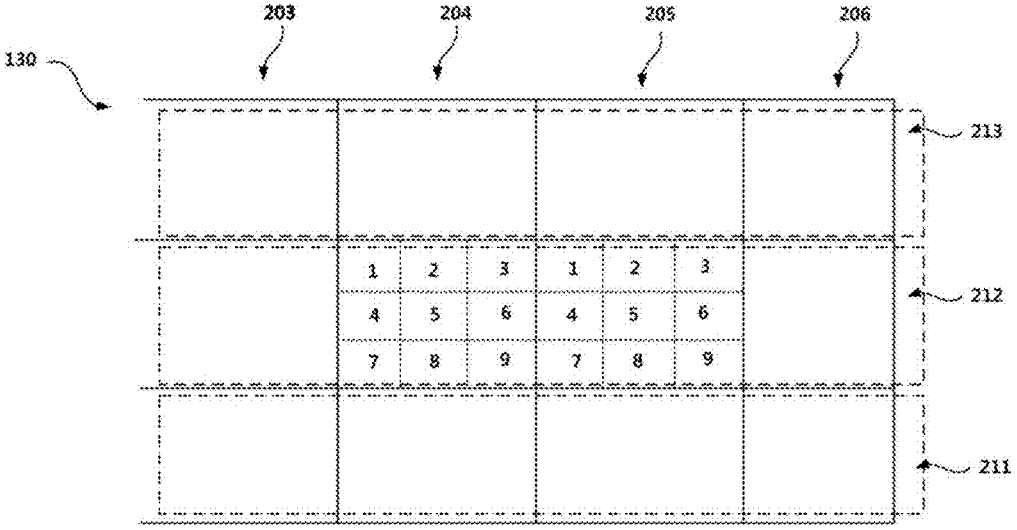
FIG. 18 provides ideas which can allow a target plate to locate at a part of the entire area of one bullet collecting box 1 according to the present invention and sequentially change its position, thereby uniformly utilizing the entire frontal area of one bullet collecting box when collecting bullets.

FIGS. 17 and 18 provide ideas which can locate a target plate at a partial position of the entire area of one bullet collecting box 1 and sequentially change its position in accordance with the present invention, thereby uniformly utilizing the entire frontal area of one bullet collecting box when collecting bullets. As shown in FIG. 17, the reason which allows the target plate 110*a* to be one-sided and located at a part of the entire area of the bullet collecting box is for improving the utilization of the rubber plate beaten zone, and the position of the target 110 is adjusted for each firing, thereby performing the firing.

As shown in FIGS. 17 and 18, when nine reduced target plates are installed to one lane of fire to perform the firing, the bullets can be uniformly distributed in the bullet collecting box area (mainly two-step) with one lane of fire. That is, when performing the firing while changing the position of the target 110 as shown in FIG. 17, it can prevent the bullets from getting intensively stuck in only one part of the beaten zone and the bullets can get uniformly stuck in the entire area. In this way, it is possible to prevent any one part of the front rubber plate 4 and the inner rubber plate 6 from being intensively fired and destroyed. That is, when uniformly utilizing the entire beaten zone while moving the position of the target 110 as shown in FIG. 18, it is possible to prevent the front rubber plate 4 and the inner rubber plates 6,7 from being intensively torn a hole and broken, thereby increasing the service life of a rubber plate.

In FIG. 18, for example, the beaten zone with two-stage height provided in the fourth lane 204 and the fifth lane 205 are divided into nine sub-beaten zones, respectively. Then, if the target is sequentially and alternately positioned per the respective sub-beaten zones 1-9, it is possible to uniformly take advantage of the whole area of the rubber plates of the bullet collecting box located in the beaten zone 212. Therefore, it is possible to prevent breakage of rubber plates and to use for a long period of time.

Figure 19:
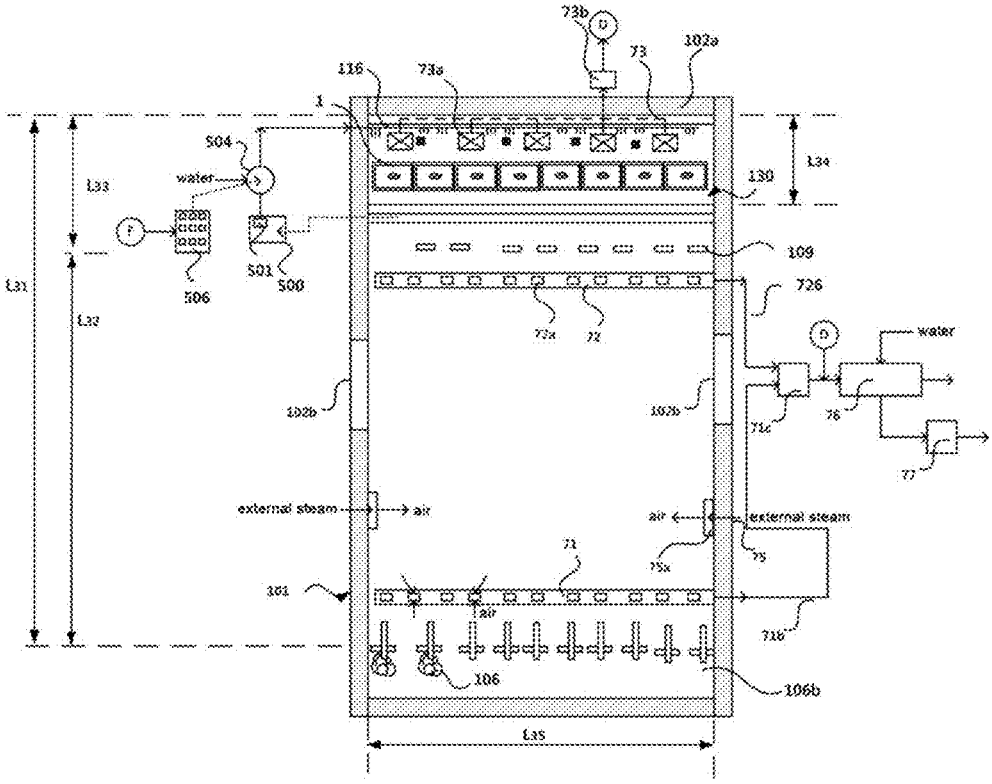
FIG. 19 shows a plan configuration of a bullet collecting system for preventing occurrence of lead fume in the indoor shooting range according to the present invention.

FIG. 19 shows a plane configuration of a bullet collecting system for preventing occurrence of lead fume in the indoor shooting range according to the present invention. The indoor shooting range 101 has generally a planar structure of the square shape, and the inside of the bullet collecting unit 130 is installed with a plurality of fire detecting sensors 10, 8, and the upper side of the bullet collecting unit 130 is installed with an air intake hood 73*a*. The air intake hood 73*a* and the third air discharge duct 73 connected thereto are equipments for discharging the contaminated air such as dusts generated from the bullet collecting unit 130 to the outside. The air inside the shooting range 101 is sucked into the air intake hood 73*a* through an air induced blower 73*b*, and is discharged to the outside through the third air discharge duct 73. Further, the first and second air suction ducts 71, 72 are long-installed along the width direction of the shooting range 101 near the firing position 106*a* and the target plate 109. The first and second air intake ducts 71, 72 are installed with a plurality of air inlets 71*a*, 72*a*. Since the first and second air intake ducts 71, 72 are connected with an induction blower 71*c*, the contaminated air such as gunpowder smoke or dust inside the shooting range 101 by the operation of the induction blower 71*c* is sucked into the air intake ducts 71, 72 through the air inlets 71*a*, 72*a* and then discharged to the outside of the shooting range. At this time, the contaminated air collected through the air intake ducts 71, 72, 73 is converted into a clean state through the air purification device 76 and then discharged to the outside. Water used for removing contaminants such as dust during this process is cleanly purified by the water treatment device 77 and then discharged to the sewer.

The contaminated air within the indoor shooting range 101 generated by the gun fire is quickly discharged to the outside via the air discharge means in this way. On the other hand, there is a need to install an air supply means which supplies an external fresh air to the inside of the indoor shooting range 101. Wall surface 102*a* of the shooting range 101 can be provided with an air supply device 75*a* as many as the number required. The air supply device 75*a* is connected to an air supply duct 75 connected to an external ventilation fan (not shown) and thus the external fresh air can be given inside the indoor shooting range 101.

Apart from this, in a case where the indoor shooting range is installed on the ground, it is desirable for the external air to naturally put into the room by installing a big door (102*b*) on the wall 102*a* and opening the door 102*b*.

On the other hand, in FIG. 19, the reference numeral L31 refers to the distance from the firing position of the indoor shooting range 101 to the rear position of the bullet collecting unit 130, the numeral L32 refers to the distance from the firing position 106*a* to the target plate 109, the numeral L33 refers to the distance from the target plate 109 to the rear position of the bullet collecting unit 130, and the numeral L34 refers to the length in the back and forth direction of the bullet collecting unit 130. For example, in the indoor shooting range 101, the numeral L31 can be set to 35-70 m, L32 can be set to 30-60 m, L33 can be set to 5-10 m, and L34 can be set to 2-4 m. Also, the width L35 of the indoor shooting range 101 can be set to 15-25 m. In the case of the indoor shooting range having the width L35 of about 20 m, it is possible to operate around ten lanes of fire.

Figure 20:
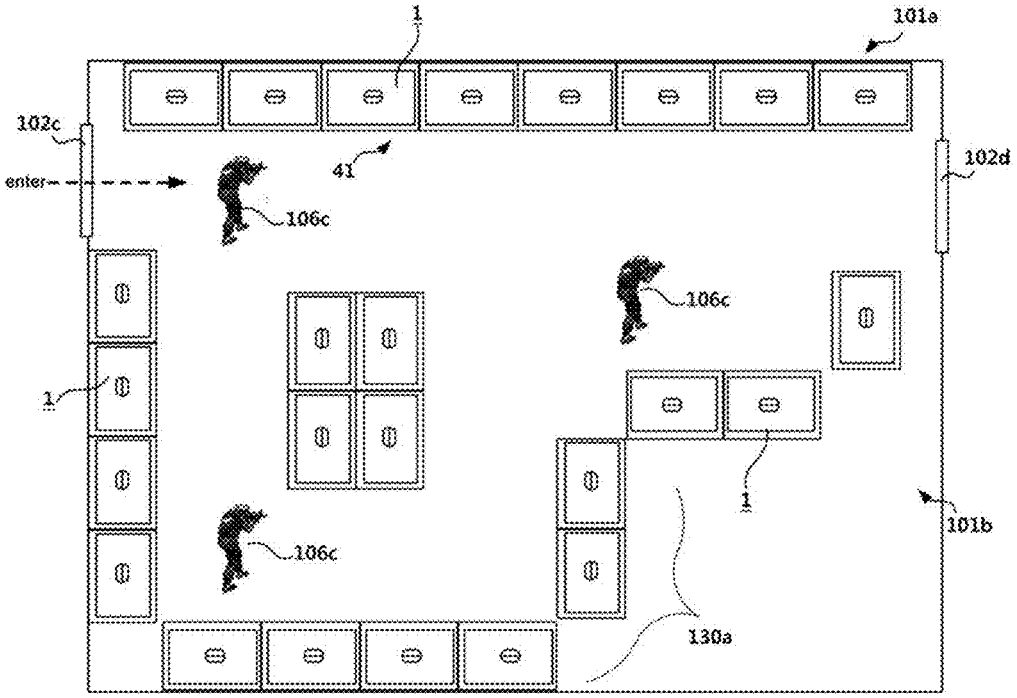
FIG. 20 shows an example where the bullet collecting box 1 according to the present invention is installed in the indoor shooting range 101*a* configured so as to perform a firing exercise in a special situation such as counterterrorism operation.

FIG. 20 shows an example where the bullet collecting box 1 according to the present invention is installed in the indoor shooting range 101*a* configured so as to perform a firing exercise in a special situation such as a counterterrorism operation. Recently, terrorism has been committed by foreign terrorist groups such as al-Qaeda or IS in foreign countries such as Europe. Korean ships have frequently been hijacked by pirates or the like and have suffered terror attacks. In order to quickly protect our people's lives and property from the threat of these terrorist organizations, the firing exercise of the special unit such as a counterterrorism force to combat the terrorist organization is desperately required. In particular, closely performing the firing exercise at close range is assumed to be important. To this end, the bullet collecting box according to the present invention can be installed in the counterterrorism operational training shooting range to effectively collect bullets.

The counterterrorism training shooting range 101*a* shown in FIG. 20 is provided with a similar inner space to the real terrorism suppression place. The bullet collecting boxes 1 are vertically stacked and installed to the wall portion of the interior space and then the target 41 is adhered to the bullet collecting boxes 1. Thereby, the training soldiers 106*c* can perform the counterterrorism firing training. For example, the soldiers 106*c* enter the inlet 102*c* on the left side of the counterterrorism training shooting range in FIG. 20 and then perform the firing to the target 41 of the bullet collecting boxes 1 while moving along the passage, and finally get out to to the outlet (102*d*) while moving continuously.

Since the conventional shooting range was not installed with bullet collecting equipments capable of installing slimly to the wall, there was no method for collecting and recovering bullets in the shooting range consisting of narrow passages such as counterterrorism shooting training range. However, according to the present invention, the bullet collecting boxes 1 can be stacked and installed in close contact with the inner portion 101*b* of the shooting range, thereby providing the advantage of allowing the bullet collection during anti-terrorism training.

Figure 21:
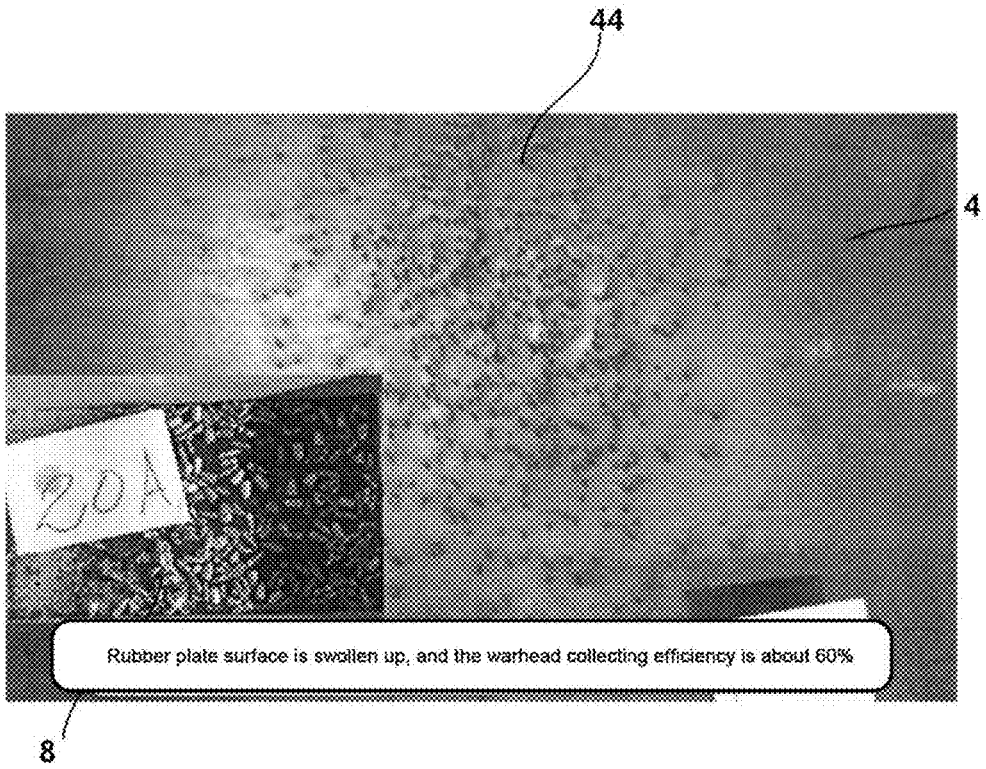
FIGS. 21 and 22 show the results of the testing fire per materials of the front rubber plate by applying the bullet collecting box according to the present invention to the indoor shooting range.
Figure 22:
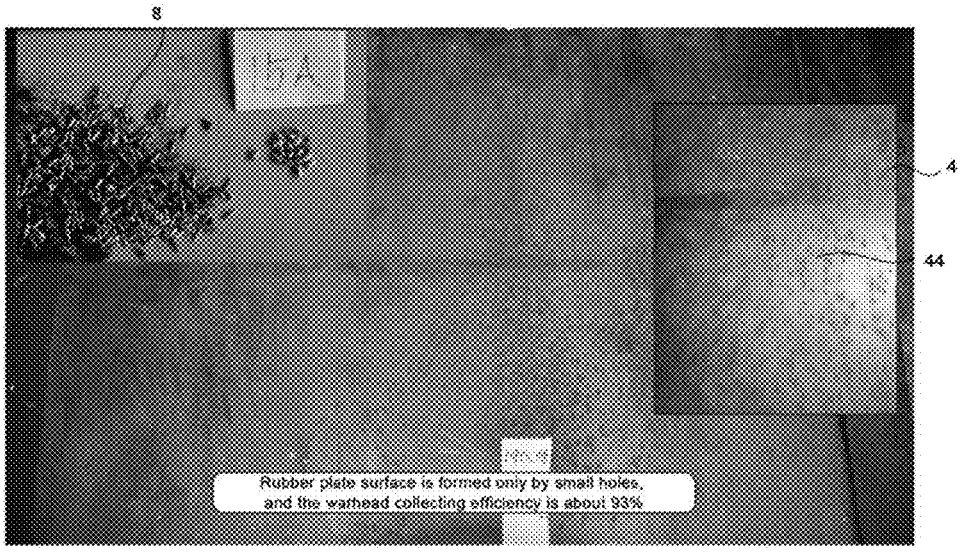

FIGS. 21 and 22 show the results of the testing fire per materials of the front rubber plate by applying the bullet collecting box according to the present invention to the indoor shooting range. Referring to FIG. 21, it can be seen that, in the case of using a belt-type soft rubber, the phenomenon of swelling up the surface of the rubber plate appears and thus the durability is lowered. That is, it can be confirmed that the rubber plate of a flexible material generates large bullet holes and does not withstand the load of the powder filling material 9 inside the bullet collecting box. In addition, when using a material such as a rubber powder having a particle size of 2 mm as the powder filling material 9, it has been found that the damage of bullets is generated by a friction caused by the impact of the bullets and the bullet collecting efficiency is only about 60%.

On the other hand, when using a belt type hard rubber plate made of a fiber in the inside and also using powder filling materials 9 with a particle size of 1.5 mm or less (FIG. 22), it has been found that there is substantially no damage to the rubber plate and the bullet collecting efficiency is enough high to reach about 93%. Taken together these results, in the present invention, when using the powder filling materials having a particle size of below 1.0 mm, particularly a small particle size of below 1.5 mm, it can be seen that the possibility to collect the bullets in an intact state is higher.

Figure 23:
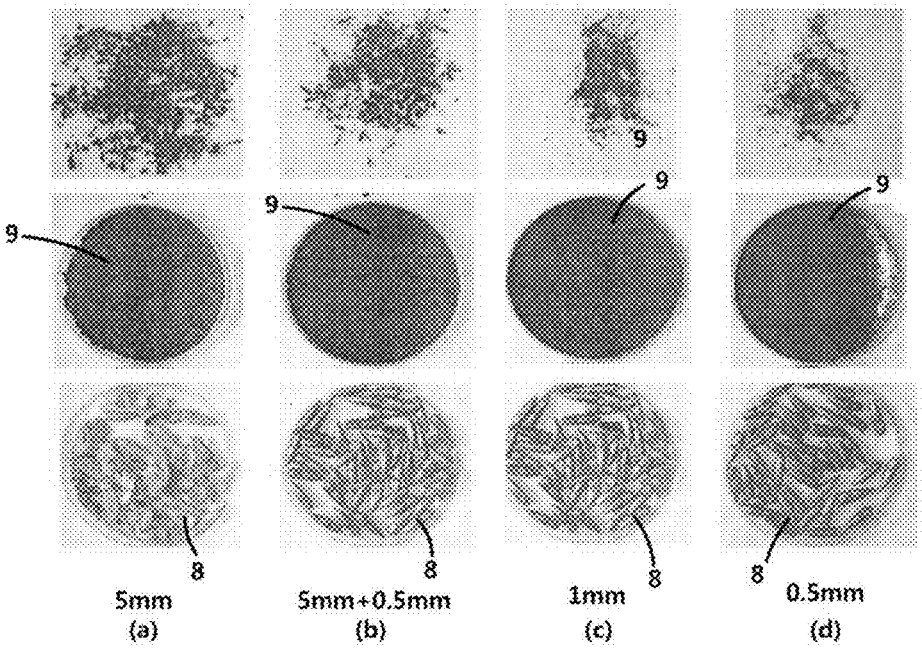
FIG. 23 shows a collection state of bullets 8 per the particle size of the powder filling materials 9 used in the bullet collecting system for preventing occurrence of lead fume according to the present invention.

FIG. 23 shows a collection state of bullets 8 per the particle size of the powder filling materials 9 used in the bullet collecting system for preventing occurrence of lead fume according to the present invention. First, when the particle size of the rubber powder used as a filling material in the bullet collecting system according to the present invention is 5 mm, it can be seen that the bullet has a lot of damage (FIG. 23(*a*)). Next, when the particle size of the rubber powder is 1 mm, relatively less damage is visible (FIG. 23(*b*)), and when the particle size of the rubber powder is 0.5 mm, the bullet is collected as it is, substantially without damage (FIG. 23(*d*)).

Figure 24:
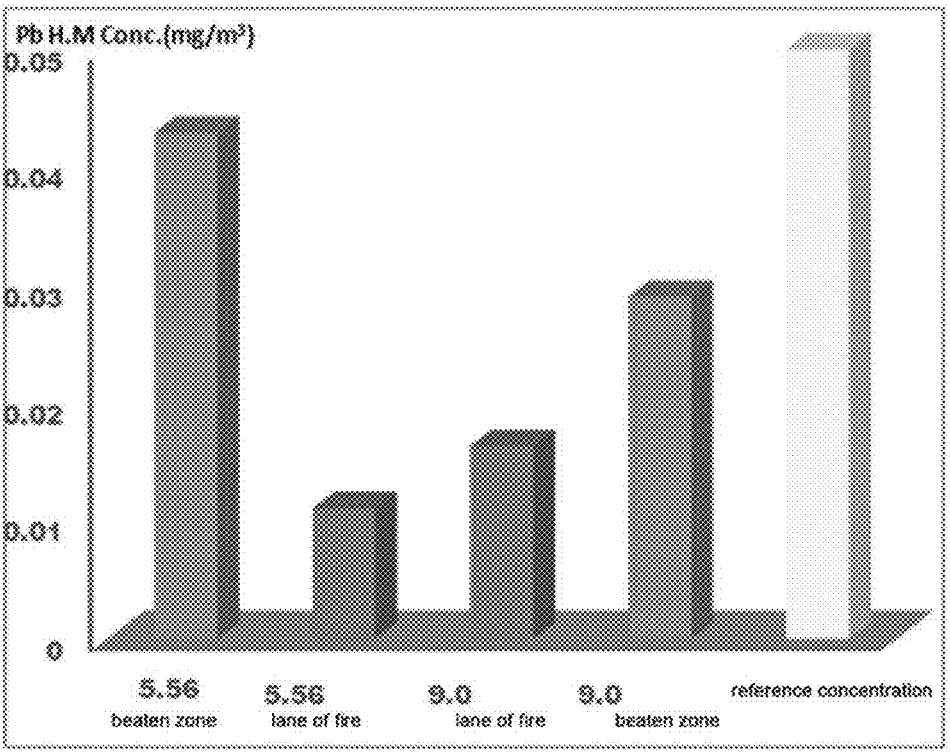
FIG. 24 shows the results of the measurement of the lead concentration after the firing exercise in the bullet collecting system for preventing occurrence of lead fume in the indoor shooting range according to the present invention.
Figure 25:
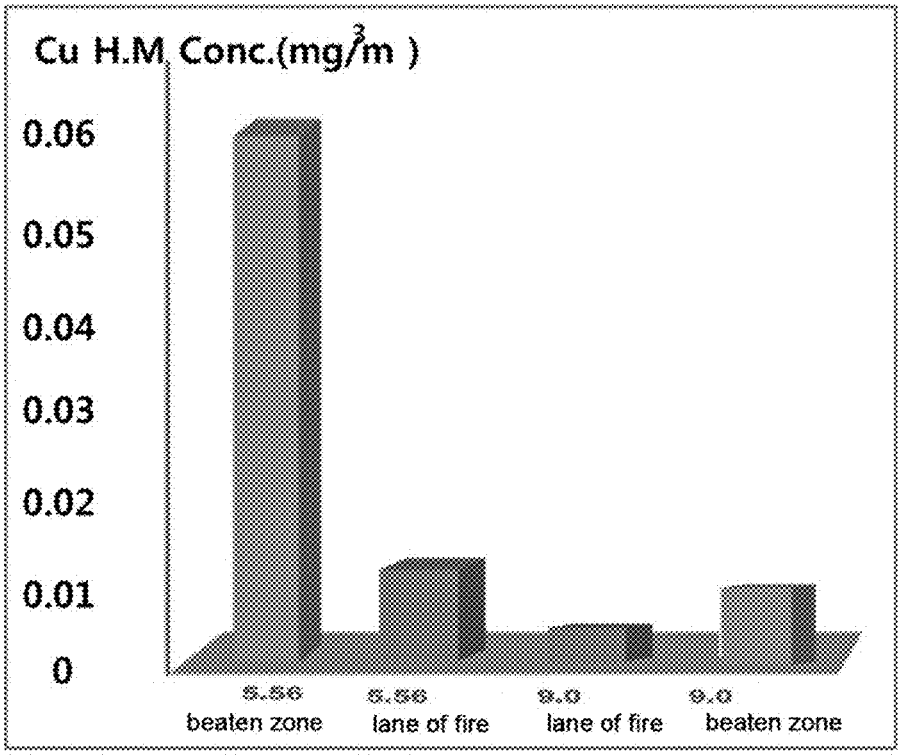
FIG. 25 shows the results of the measurement of the copper concentration.

FIG. 24 shows the results of the measurement of the lead concentration after the firing exercise in the bullet collecting system for preventing occurrence of lead fume in the indoor shooting range according to the present invention, and FIG. 25 shows the results of the measurement of the copper concentration. First, referring to FIG. 24, in the bullet collecting system for preventing occurrence of lead fume in the indoor shooting range according to the present invention, after performing the firing exercise using a normal bullet of 5.56 mm and a normal bullet of 9.0 mm, the result of measuring the lead concentration showed that the lead concentration in the lane of fire and the beaten zone is detected lower than the reference value.

In addition, referring to FIG. 25, in the indoor shooting range to which bullet collecting system for preventing occurrence of lead fume according to the present invention is applied, the result of measuring the copper concentration after performing the firing exercise using a normal bullet of 5.56 mm and a normal bullet of 9.0 mm shows that the copper concentration in the line of fire and the beaten zone is detected lower than the reference value.

Figure 26:
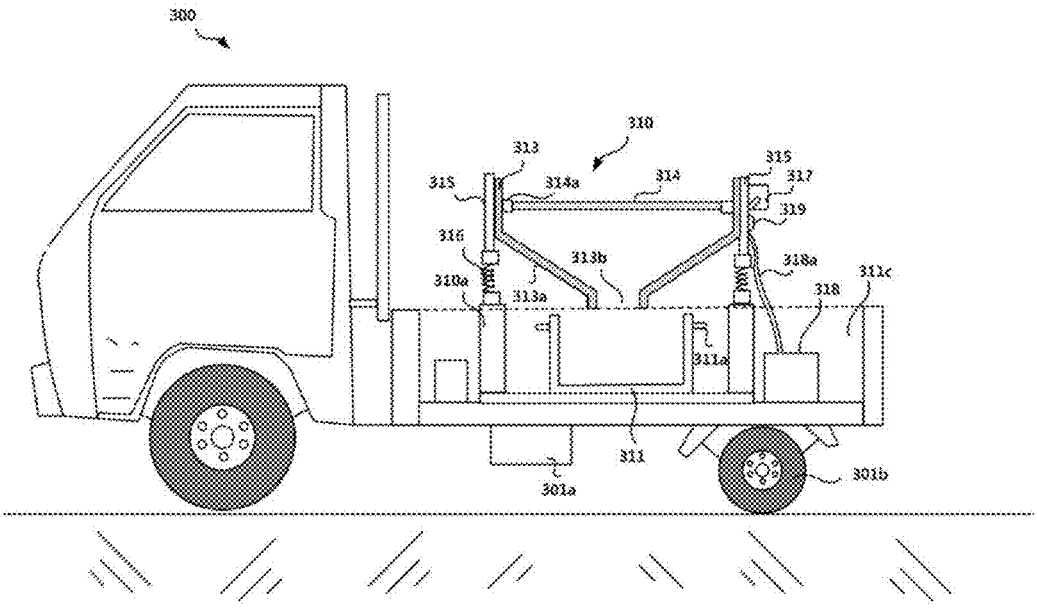
FIG. 26 shows a movable bullet separating and collecting apparatus 310 for collecting the bullets 8 obtained from the indoor shooting range according to the present invention, and illustrates an example where the bullet separating and collecting apparatus 310 is installed on the bullet collecting vehicle 300.

FIG. 26 shows a movable bullet separating and collecting apparatus 310 for collecting the bullets 8 obtained from the indoor shooting range according to the present invention, and illustrates an example where the bullet separating and collecting apparatus 310 is installed on the bullet collecting vehicles 300. After collecting bullets in the shooting range using the bullet collecting box 1 according to the present invention, there is a need to effectively separate the bullets 8 which are mixed with the powder filling material 9. To this end, the present inventors have developed a movable bullet separating and collecting apparatus 310 which can move per the necessary shooting range by installing to a vehicle such as a truck, and filed a patent application no. 10-2004-0195543 relating to the apparatus with the Korean Intellectual Property Office on Dec. 21, 2014.

Referring to FIG. 26, the movable bullet separating and collecting apparatus 310 is installed with a lower support 320 on the loading platform 311*c* of the vehicle 300 such as a truck, and a plurality of support posts 310*a* are erected in the peripheral portion of the lower support 320. A hopper support 315 and a vibrating hopper 313 are installed to the support posts 310*a* through the buffer springs 316. The vibrating hopper 313 serves to shake the separating screen 314 by the vibration in the vertical and horizontal directions and separate the things applied to the separating screen 314. The separating screen 314 may take a mesh shape made of a metallic material or synthetic resin material. The size of the mesh is greater than the size of the powder filling material 9 contained within the bullet collecting box 1 and lower than the size of bullets 8. Thus, when the separating screen 314 is vibrated, the powder filling material 8 dropped and then stacked up on separating screen 314 escape the meshes of the separating screen 314, go through the hopper outlet 313*b* and enter and stack inside the filler collecting barrel 311. The bullets 8 mixed with the powder filling materials 9 are to be left as they are, on the meshes of the separating screen 314.

The vibrating hopper 313 is configured such that the upper opening is open at the top, and thus the bullet collecting box 1 can be placed thereon (see FIG. 28), and the bottom is formed with a hopper outlet 313*b* having a narrowed area. The upper side of the hopper outlet 313*b* is provided with an inclined portion 313*a*, and the powder filling materials 9 passed through the meshes of the separating screen 314 come down with sliding along the inclined portion 313*a* and escaped to the hopper outlet 313*b*.

The circumference of the separating screen 314 is a border of metal or synthetic resin materials and combined with a screen frame 314*a*. As the screen frame 314*a* put on the inner surface of the vibrating hopper 313, the separating screen 314 is fixed to the inside of the vibrating hopper 313.

The outside surface of the vibrating hopper 313 is combined with a plurality of hopper supports 315, and each of the hopper supports 315 is elastically supported by the lower supporting posts 310*a* through the buffer springs 316. Although the vibrating hopper 313 is violently vibrated by a vibrator 317, the vibration can be properly absorbed by the buffer springs 316.

The vibrator 317 starts to vibrate when setting a power switch 319 to "ON". The power switch 319 is connected to a power supply device 318 via a wire 318*a*. The power supply device 318 can supply the power from the vehicle battery 301*a*, or it can supply electricity by means of a separate generator engine.

Figure 27:
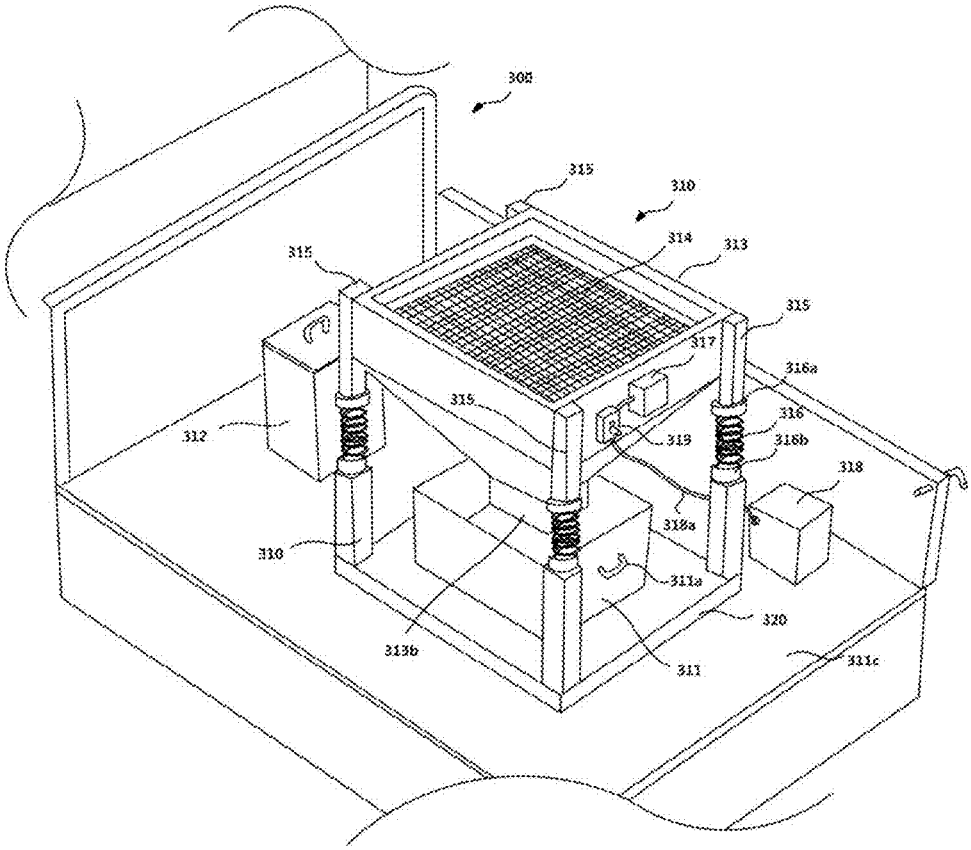
FIG. 27 shows a perspective view of the movable bullet separating and collecting apparatus 310 shown in FIG. 26.

FIG. 27 shows a perspective view of the movable bullet separating and collecting apparatus 310 shown in FIG. 26. A reference numeral 312 (not described) is a bullet storage barrel, and the bullets 8 remaining on the separation screen 314 by the operation of the vibrating hopper 313 can be put into the bullet storage barrel 312 by the operator and kept therein.

Figure 28:
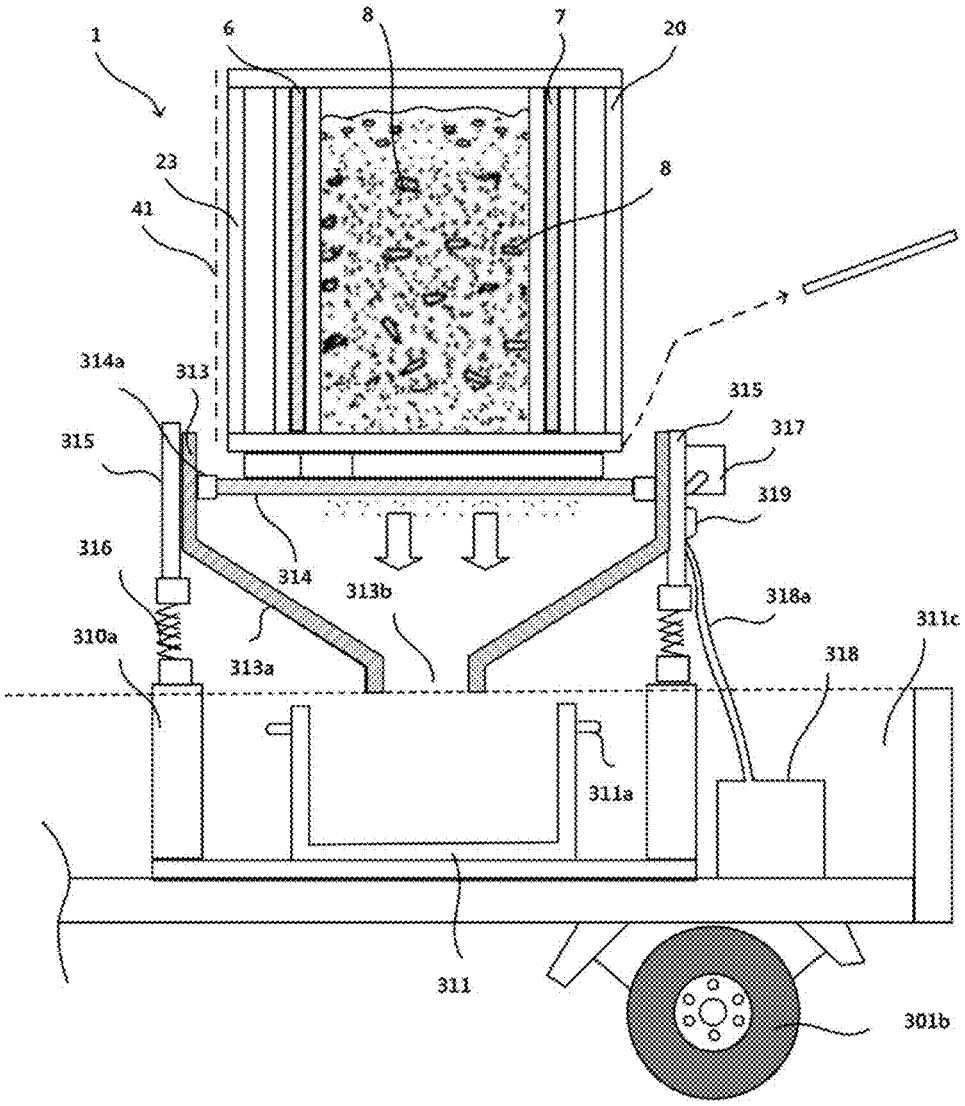
FIG. 28 shows a state where the bullet collecting boxes of FIG. 6 are mounted on the vibrating hopper 313 of the movable bullet separating and collecting apparatus 310 of FIG. 26, wherein the bottom stopper plate 53 of the bullet collecting box 1 has been removed and thus the powder filling materials 9 and bullets 8 in the bullet collecting box 1 are poured down on the separating screen 314.

FIG. 28 shows a state where the bullet collecting box 1 of FIG. 6 is mounted on the vibrating hopper 313 of the movable bullet separating and collecting apparatus 310 of FIG. 26, wherein the bottom stopper plate 53 of the bullet collecting box 1 has been removed and thus the powder filling materials 9 and bullets 8 in the bullet collecting box 1 are poured down on the separating screen 314.

Figure 29:
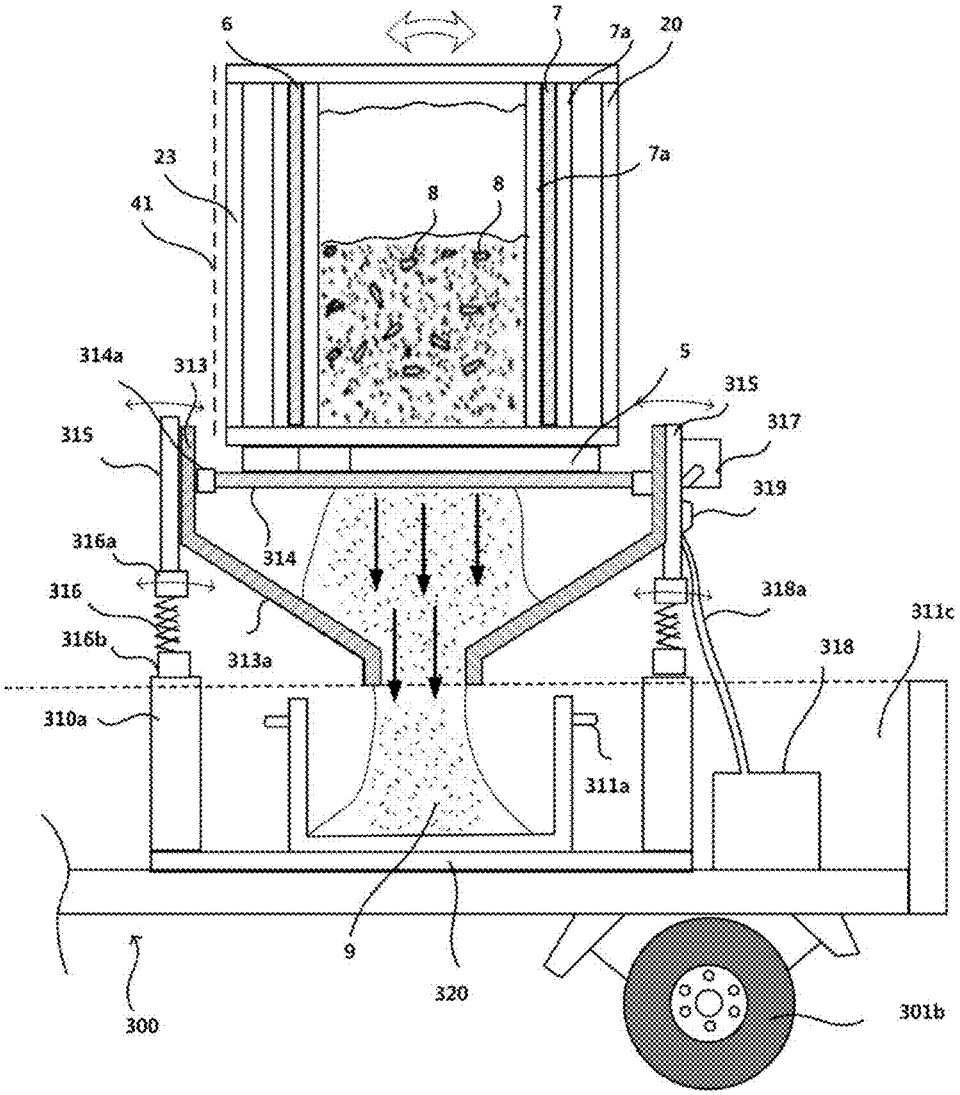
FIG. 29 illustrates a process where a vibrator 317 operates in a state of FIG. 28 and the vibrating hopper 313 forcingly shakes, thereby the powder filling materials and bullets 8 in the bullet collecting boxy 1 are poured down within the separating hopper 313 and the separation of only bullets 8 is performed by the separating screen 314.

As shown in FIG. 9 above, the bullet collecting box of the present invention can easily withdraw or combine the bottom stopper plate 53 combined to the bottom plate 51 in a sliding manner. Therefore, the operator puts the bullet collecting box 1 that collects a lot of the bullets 8 already used in the shooting range on the separating screen 314 of the vibrating hopper 313 and then withdraw the bottom stopper plate 53. By doing so, the preparation work of using the movable bullet separating and collecting apparatus 310 is substantially finished. When withdrawing the bottom stopper plate 53 and then setting the power of the vibrator 317, the bullet collecting boxes 1 are shaken and the powder fillers 9 contained therein poured down and piled up on the separating screen 314. In addition, the bullet 8 and the powder filling materials 9 are separated (see FIG. 29).

Figure 30:
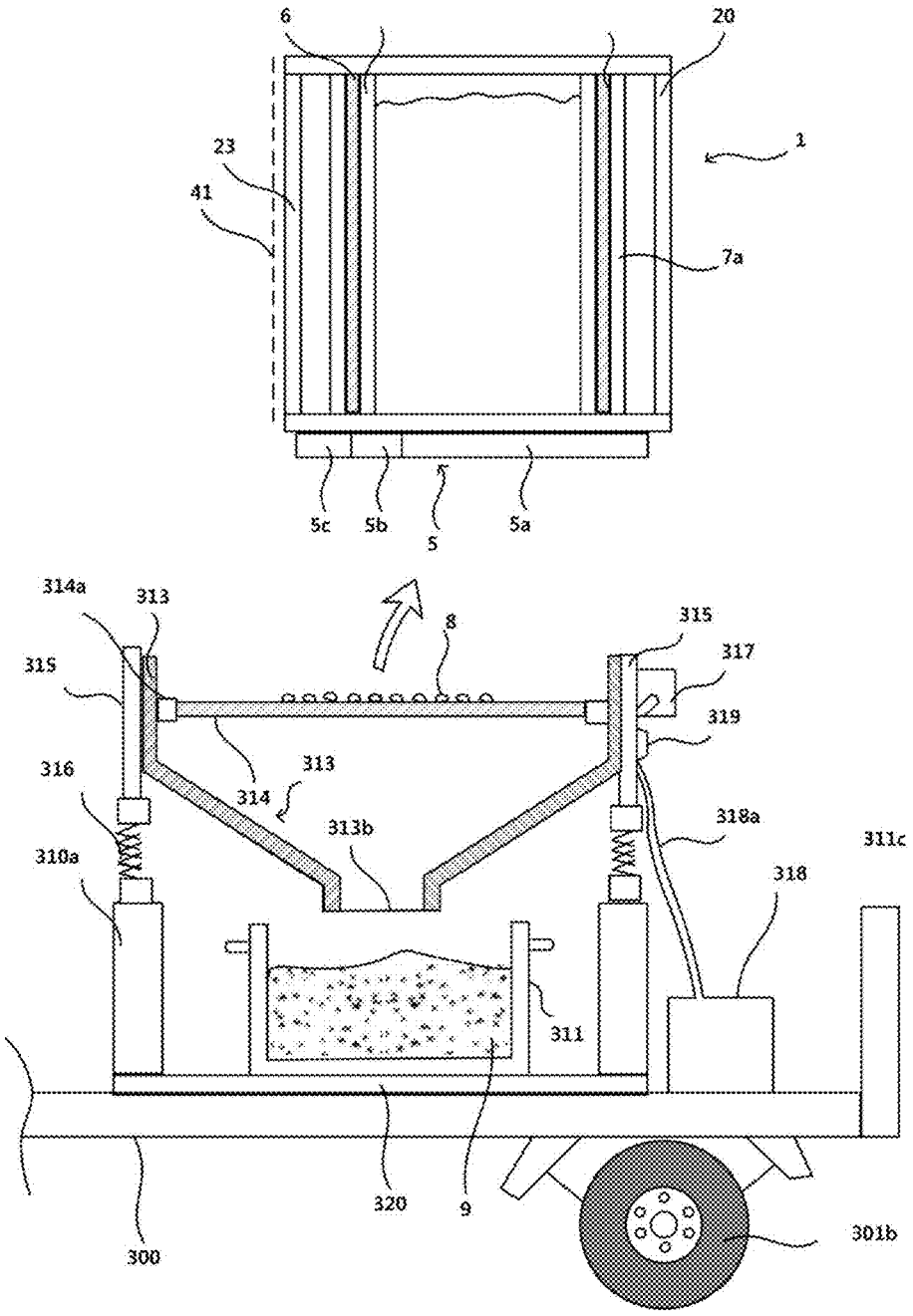
FIG. 30 shows a state where the separation between bullets 8 and powder fillers 9 using the movable separating and collecting apparatus 310 is completed, the bullets 8 remain on the separating screen 314, and the powder filling materials 9 are filled within the filler collecting barrel 311 at the bottom of the vibrating hopper 313.

FIG. 30 shows a state where the separation between bullets 8 and powder filling materials 9 using the moveable separating and collecting apparatus 310 is completed, the bullets 8 remain on the separating screen 314, and the powder filling materials 9 are filled within the filler collecting box 311 at the bottom of the vibrating hopper 313.

As set forth above, the bullet collecting box 1 according to the present invention can be installed with the indoor shooting range. For example, after a lapse of a period of time such as six months, the bullet collecting box 1 can easily collect the bullet and the powder filling materials using the separating apparatus such as the movable separating and collecting apparatus 310 (see FIGS. 26 to 30).

Figure 31:
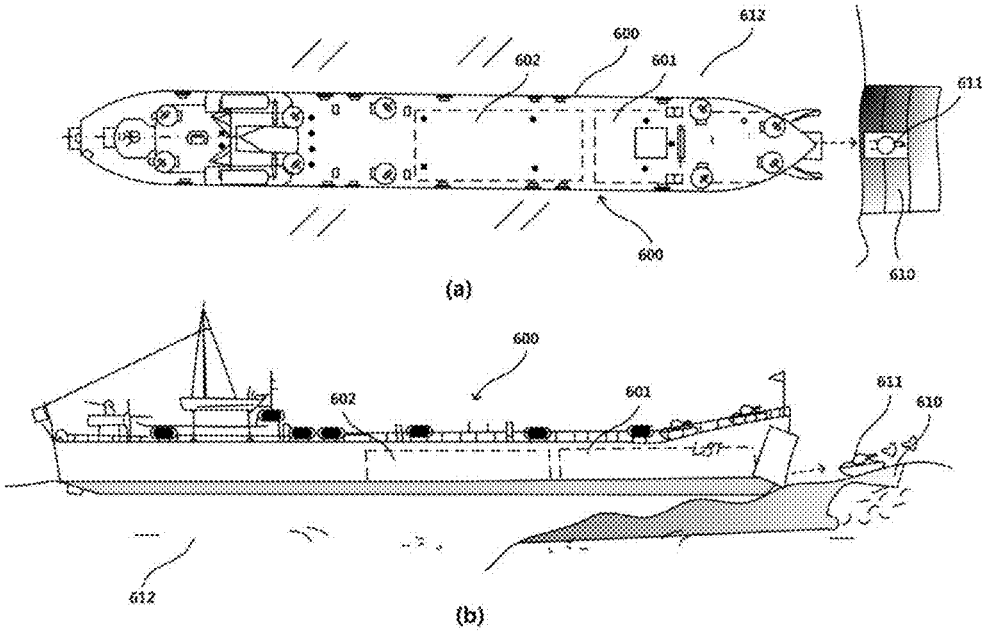
FIG. 31 is a plan view (FIG. 31(*a*)) and a side view (FIG. 31(*b*)) of the LST (landing ship tank) ship 600.

FIG. 31 is a plan view (FIG. 31(*a*)) and a side view (FIG. 31(*b*)) of the LST (landing ship tank) ship 600.

The bullet collecting system for preventing occurrence of lead fume in the indoor shooting range according to the present invention is not necessarily limited only to the land indoor shooting range, and it can be installed in the inner space of a vessel such as a warship in order to increase the shooting techniques of naval soldiers. For example, the LST ship 600 is a ship for landing operations and has a large internal space 601, 602 that the tank, helicopter or the like may enter therein. These LST ships, if the used term expired and retired, are exported to Southeast Asian countries. If these retired waste ships are recycled and installed with the indoor shooting range having the bullet collecting system according to the present invention, it can be utilized as a place to perform the firing exercise of naval soldiers and special operations soldiers. Particularly, in the case of naval soldiers working on the ship, it is practically difficult to return to the land for only firing exercise and thus now it is substantially impossible to perform firing exercise. However, in terms of the current situation where the importance of the firing exercise in the naval combat is greatly increased, if the waste ships are installed with the indoor shooting range and utilized as the equipments for rifle shooting training of naval soldiers, it is expected to contribute significantly to the improvement of the combat strength of the Navy.

On the other hand, in FIG. 31, the reference numeral 610 refers to a land, and the numeral 612 refers to a sea.

Figure 32:
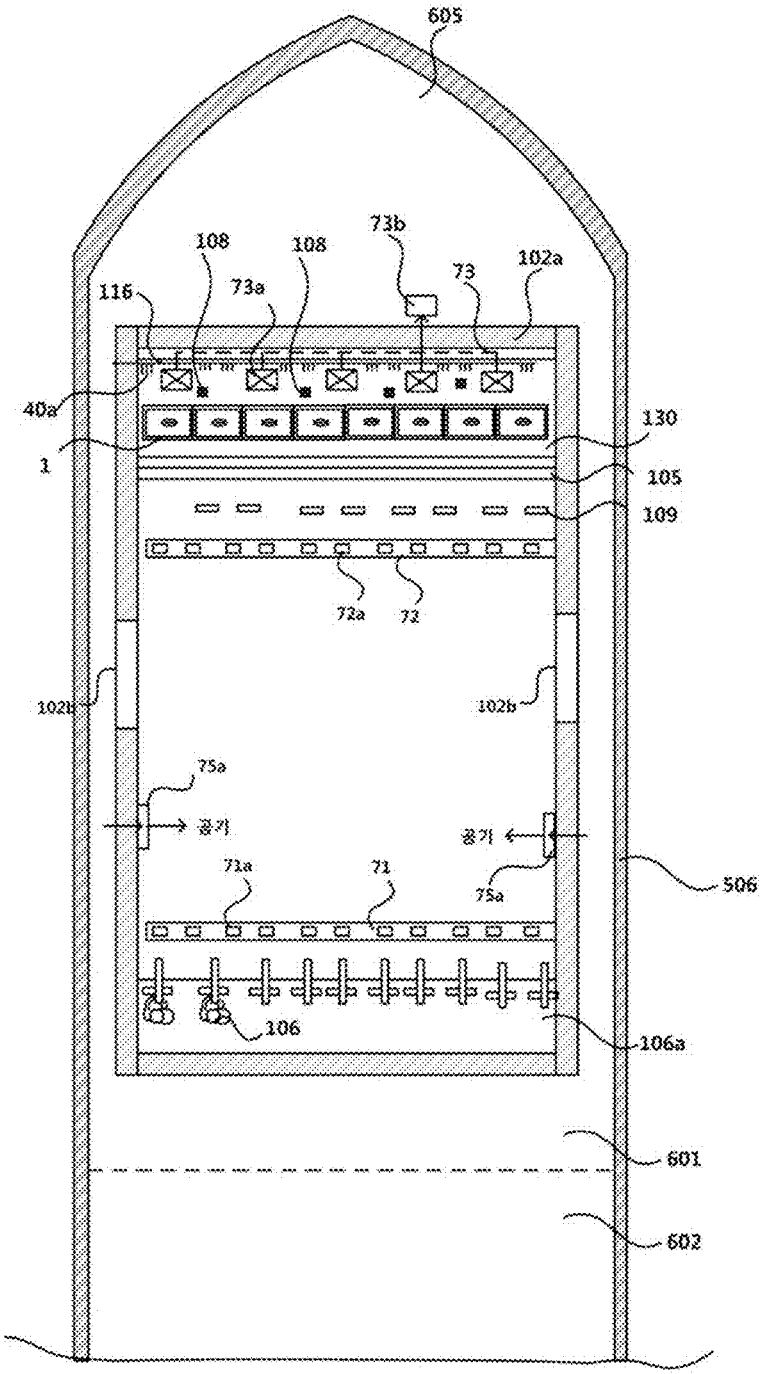
FIG. 32 shows an example in which the indoor shooting range to which the bullet collecting system according to the present invention has been applied is installed in the inner space 601 of the LST ships in FIG. 31.

FIG. 32 shows an example in which the indoor shooting range to which the bullet collecting system according to the present invention has been applied is installed in the inner space 601 of the LST ships in FIG. 31.

As shown in FIG. 32, since the LST ships 600 have a sufficiently broad left and right width of more than 20-30 m, the indoor shooting range 101 and the bullet collecting system 100 according to the present invention can be applied to a space therein.

Figure 33:
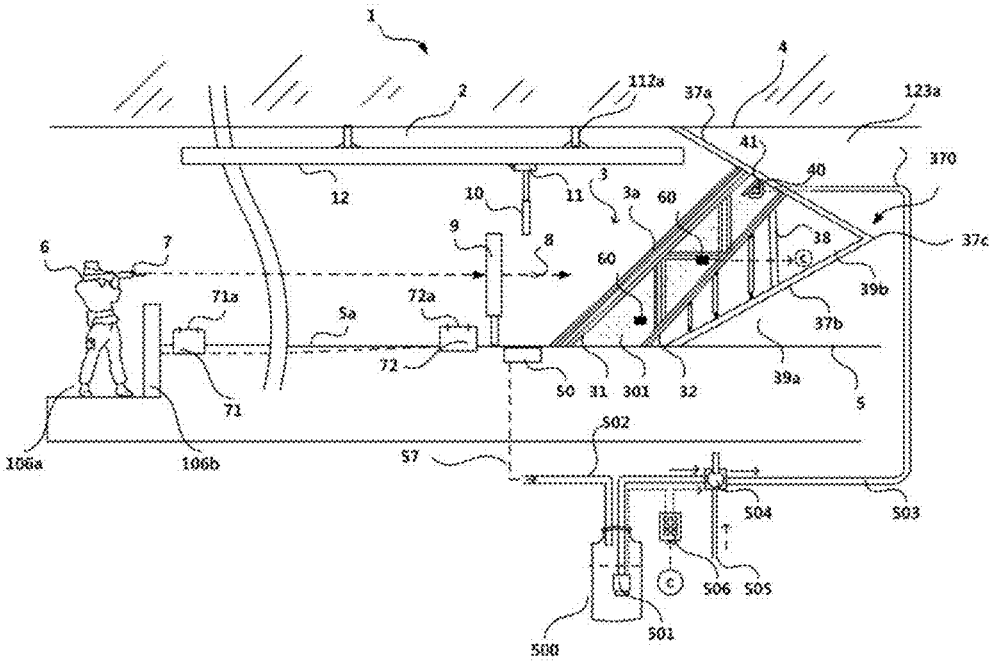
FIG. 33 shows an overall configuration of a bullet collecting system for preventing occurrence of lead fume in the indoor shooting range according to the present invention.

FIG. 33 shows an overall configuration of the bullet collecting system for preventing occurrence of lead fume in the indoor shooting range according to the present invention.

Referring to FIG. 33, the firing position 6*a* is provided at one end of the indoor shooting range 2, and the bullet collecting unit 3 is provided on its opposite side. At the firing position 6*a*, a gunner 6 is capable of firing the firearm 7, and the bullet 8 flown from the firing position 6*a* goes through the target plate 9, penetrates into the bullet collecting space 300 of the bullet collecting unit 3 and then stops. Since the powder filling materials 301 consisting of small grains, such as rubber powder, are filled within the bullet collecting space 300, the bullet 8 goes through the front rubber plate 3*a* and penetrates into the bullet collecting space 300 and then collides with the powder filling materials 301. Thereby, the kinetic energy is dissipated and the bullet is safely stopped as it stands, without breakage or cracking.

Since the conventional indoor shooting ranges which are operated by the military unit, the police training center or the like have used an iron plate beaten zone 370, in order to more easily apply the bullet collecting unit 3 of the bullet collecting system according to the present invention to the conventional indoor shooting ranges, it is preferable to utilize and install the iron plate beaten zone 370 equipments, rather than removing the existing iron plate beaten zone 370, and additionally incorporate and install the bullet collecting unit 3. That is, as shown in FIG. 33, the conventional indoor shooting ranges 2 are configured such that the iron plate-beaten zone 370 consisting of the conventional upper iron plate 37*a* and the conventional lower iron plate 37*b* are present on the opposite end of the firing position 6. However, it is preferable to install the bullet collecting unit 3 by utilizing these conventional iron plate-beaten zones 370 as they are.

For the conventional iron plate beaten zone 70, the conventional upper iron plate 37*a* and the conventional lower iron plate 37*b* have been installed in a state of being spread in a shape of ">" in order for the bullet 8 to collide with the iron plate and then not bounce off to the outside. That is, the conventional upper iron plate 37*a* has been configured such that the front end is connected to the ceiling. It has been installed in an inclined state so that the height is gradually increased toward the rear side of the indoor shooting range. Also, the conventional lower iron plate 37*b* has been configured such that the front end is fixed to the bottom surface 5 of the shooting range 2. It has been installed in an inclined state so that the height is gradually increased toward the rear side of the indoor shooting range. Consequently, the conventional upper iron plate 37*a* and the conventional lower iron plate 37*b* have been spread in a shape of ">", just like opening the mouth, toward the firing position 106*a*, and the rear end of the iron plates 37*a*, 37*b* are met and combined with each other at the rear end.

In order to make the bullet collecting space 300 of the bullet collecting unit 3 according to the invention, it is necessary to construct a closed space that can be placed by filling the powder filling materials 301. To this end, the beaten zone structure frame 30 (see FIGS. 34 and 35) is primarily installed with the iron plate beaten zone 370. A plurality of supporting columns 38 are installed uprightly on the lower underlying iron plate 37*b* of the iron plate beaten zone 370 to support the lower part of the beaten zone structure frame 30. Since the second inclined installation pipes 32 are located at the lower part of the beaten zone structure frame 30, the second inclined installation pipes 32 or the pipe structures where the second inclined installation pipes 32 are welded or combined are supported by the support columns 38.

According to the present invention, the bullet collecting space 300 of the bullet collecting unit 3 is prepared so that its cross-sectional structure is similar to the parallelogram. By maintaining the cross-sectional structure of the bullet collecting space 300 in this way, the bullet collecting space 300 can be minimized, and as a result, the amount of the powder filling material 301 to be filled into the bullet collecting space 300 can be minimized.

Furthermore, according to the present invention, in order to minimize the replacement frequency of the powder filling materials 301 filled in the bullet collecting space 300, the bullet collecting space 300 is divided into up and down by installing the upper and lower bending plate 340 (FIG. 20 to FIG. 23) and separated into 'upper collecting space' and 'lower collecting space'. In other words, when trying to perform a firing exercise, finally, most of the bullets 8 will intensively enter the lower collecting space. Therefore, in case where the replacement of the powder filling material 301 is necessary, the powder filling material 301 within the entire bullet collecting space 300 should not be necessarily replaced at one time, but for example, it is possible to select and replace only the powder filling materials contained in the lower collecting space. In this way, the efforts required to replace the powder filling materials 301 can be significantly effectively reduced.

As the powder filling materials 301, materials such as rubber powders with a particle size of 0.1-3 mm can be used. In this case, although the particle size of the filling materials is reduced, the bullet 8 is not damaged during the collision and penetration of the bullet 8 and thus, the collecting efficiency of the bullet can be increased. According to the experiment of the present inventors, when the filling materials such as the rubber powders have a particle size of 1.5 mm or less, the collecting efficiency of the bullet exceeds 93%, thereby achieving excellent collecting efficiency of the bullet. Further, the powder filling materials 9 that can be used here include one or more materials selected from the group consisting of a rubber, a synthetic rubber, a natural rubber, a pulverized material of waste tires, a carbon black, a silica and a silicon rubber material.

On the other hand, it is possible to mix and use the powder fire-extinguishing agent components within the powder filling materials 301. When the powder fire-extinguishing agent is included in the powder filling material 301 and filled in the bullet collecting space 300, there is an effect of quickly suppressing the fire by the fire protection function of the powder fire-extinguishing agent components even if the fire is generated due to the friction heat of the bullet 8 and the filling material 301. At this time, the weight of the powder fire-extinguishing agent mixed within the powder filling material 301 is preferably set to 2-10% of the total weight of the powder filling material 301.

Figure 34:
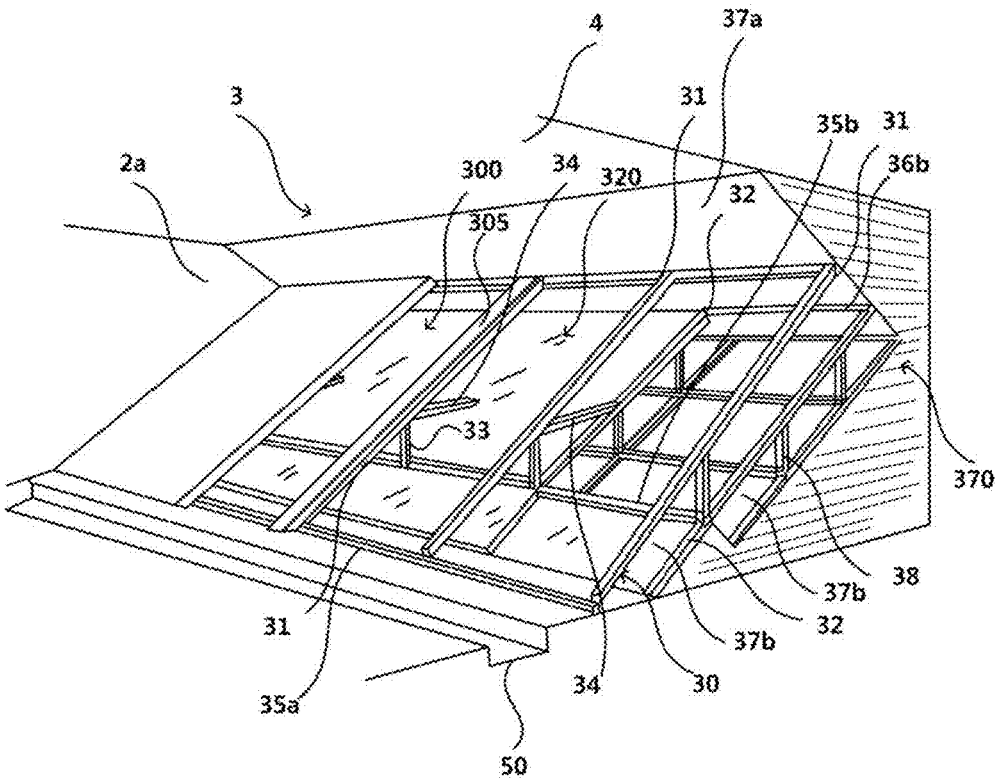
FIG. 34 shows a perspective view of a bullet collecting system for preventing occurrence of lead fume in the indoor shooting range according to the present invention.
Figure 35:
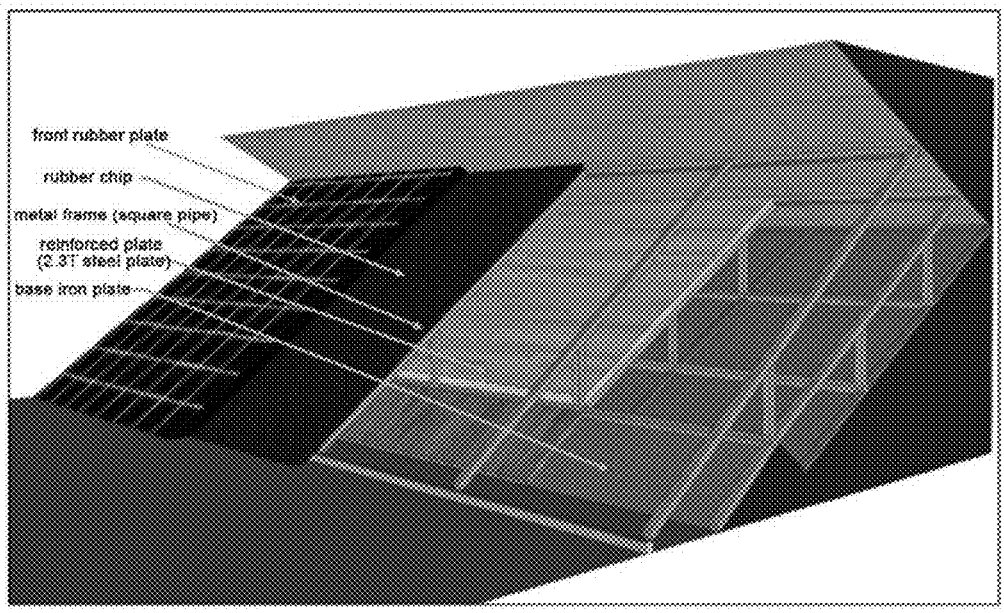
FIG. 35 shows a rendered view of a bullet collecting system for preventing occurrence of lead fume in the indoor shooting range according to the present invention.

Referring to FIG. 33, the front rubber plate (3*a*) forming the front side of the beaten zone structure frame 30 is supported by the first inclined installation pipes 31, and the second inclined installation pipes 32 located in the lower side of the first inclined installation pipe 31 are combined and installed with the fire protection plate 320 (see FIGS. 34 and 35). The fire protection plate 320 acts as a bottom plate of blocking the powder filling materials 301 from being escaped to the bottom and also it is prepared by a material having excellent heat resistance and fire resistance. Therefore, it serves to prevent the generation of a fire due to a friction heat caused during the collection of the bullet 8.

The upper end of the bullet collecting space 300 is installed with a spray pipe 40 capable of spraying water, and the circumference of the spray pipe 40 is installed with a metal protective case 41 along the longitudinal direction, thereby preventing the spray pipe from being damaged due to impact with the bullet 8. On the other hand, the bottom plate of the protective case 41 is formed with a large number of holes 42 (FIG. 8). Thus, water discharged from the spray pipe 40 can be easily penetrated between the powder filling materials 301 of the bullet collecting space 300.

In the spray pipe 40, water is supplied by the water supply pipe 503. If the fire or smoke is detected by the fire detecting sensor 60, the control unit 506 operates an electric valve 504 and a water pump 501 to supply water to the water water supply pipe 503.

On the other hand, the water discharged by the spray pipe 40 is drained to the outside of the indoor shooting zone 2 via the drain trench 50 formed immediately in front of the bullet collecting unit 3. The water thus discharged flows and gathers into the water collecting tank 500 through a drainage pipe 51 and a water inlet pipe 502. The water collecting tank 500 may be installed under the ground in the space of the indoor shooting range 20 or it may be installed adjacent to the outside of the building of the shooting range. In order to enable natural draining flow of water, it is preferable that the water collecting tank 500 is buried in the ground.

The water flown through the drainage trench 50 is gathered inside the water collecting tank 500. The water pump 501 is installed in the water, and water can be supplied to the water supply pipe 503 by the operation of the pump 501. The electric valve 504 is installed in the line of the water supply pipe 503, and contributes to the work where the water of the water collecting tank 500 is supplied or water is supplied from a separate water pipe and then sends to the water supply pipe 503. Therefore, the electric valve 506 preferably takes the form of a three-way valve so that it can selectively bring to take the water in the water collecting tank and the water in the water tank, and send to the water supply pipe 503. The control unit 506 is electrically connected to the fire detecting sensor 60. When it detects that the fire or smoke are generated in the bullet collecting space 130, the water pump 501 and the electric valve 504 are operated to discharge water through a spray pipe 40.

At the moment of firing the gun 7, the ammunition of bullet burns to occur the smoke of gunpowder, and even at the moment that the bullet penetrates into the rubber plates 3*a* and enters into the bullet collecting space 300, the dust is generated. Therefore, if the gunpowder smoke and the dusts are left as they are, the air in the indoor shooting range 2 is contaminated. This is not good for the health of people who participate in a firing exercise. In order to solve such a problem, the bullet collecting system 1 according to the present invention further includes an air conditioning system capable of sucking up the air near the firing position 6*a* and in front of the bullet collecting unit 3 and forcibly discharging the air. That is, according to the present invention, the first air suction duct 71 is installed in a bottom surface 5*a* close to a blocking wall 6*b* of the firing position 6*a*, and the second air suction duct 72 is installed in a bottom surface 5*a* close to the target plate 9. The first air suction duct 71 and the second air suction duct 72 are long-extended along the width direction of the indoor shooting range 2. The upper surface of the air suction ducts 71, 72 is provided with a plurality of air suction devices 71*a*, 72*a* along its longitudinal direction. Therefore, the air contaminated inside the indoor shooting range 2 are forcibly discharged to the outside through the first and second air suction ducts 71, 72 immediately.

In FIG. 33, two types of targets are illustrated together for convenience of explanation. That is, the target plate 9 in the form of being erected on the bottom surface 5*a* is shown, and the target 10 capable of automatically moving along the guide rail 12 installed in a ceiling 4 is also shown. The target moving system 11 capable of installing a target 10 mounted in the air can be moved by combining wheel 11*b* (FIG. 8) to the guide rail 12. The guide rail 12 is fixedly installed by connecting a mounting rod 12*a* to the ceiling 4.

On the other hand, the bottom surface of the indoor shooting range 2 is preferably formed by a slope gradient surface 5*a* having an inclined angle of 1-5° so that the water can be naturally drained until the firing position 6*a* and the drainage trench 50.

In FIG. 33, the reference numeral 39*a* refers to a first empty space that exists between the conventional upper and lower steel plates 37*a*, 37*b* and the rear wall of the steel plate beaten zone 370, and the reference numeral 39*b* refers to a second empty space that exists between the conventional upper and lower steel plates 37*a*, 37*b* and the bullet collecting unit 300.

FIGS. 34 and 35 illustrate an inner structure of the bullet collecting unit 3 in the bullet collecting system 1 shown in FIG. 33. The support columns 38 are erected on the iron plate beaten zone 370 that has previously been installed, and the beaten zone structure frame 30 is supported by the support columns 38. The beaten zone structure frame 30 in the front side is located in a state where the first inclined installation pipe 31 is inclined at an angle of 40-80° toward the front. The second inclined installation pipes 32 in the back side is also located in a state of being tilted. The vertical installation pipes 33 and the horizontal installation pipes 34 are connected between the first inclined installation pipes 31 and the second inclined installation pipes 32, whereby the beaten zone structure frame 30 has the overall framework. In this case, it is preferable that the first and second inclined installation pipes 31, 32 and vertical installation pipe 33 and the horizontal installation pipe 34 all use the square pipes.

On the other hand, the first lower fixing pipe 35*a* installed on the bottom surface 5 is combined with the lower end of the first inclined installation pipe 31, and the first upper fixing pipe 36*a* installed in the existing upper iron plate 37*a* is combined with the upper end of the first inclined installation pipe 31, whereby the first inclined installation pipe 31 is firmly supported by the bottom surface 5 and the upper iron plate 37*a*.

Similarly, the upper end of the second inclined installation pipe 32 is combined to the second upper fixing pipe 36*b* fixed to the existing upper iron plate 37*a*, and the lower end thereof is combined with the second lower fixing pipe 35*b* fixed to the existing lower iron plate 37*b*, whereby the second inclined installation pipe 32 can also be firmly supported on the bottom surface 5 and the existing upper iron plate 37*a*.

The fire prevention plate 320 is mounted on the upper end of the second inclined installation pipe 32 and then fixed by volts or other fastening means. If the surface toward the iron plate beaten zone 370 is clogged by the installation of the fire protection plate 320, the powder filling materials 301 (FIG. 6) can be filled in the space in the upper side thereof.

On the other hand, since the protective pad 305 is attached to the square pipes 30*a* (FIG. 14) constituting the beaten zone structure frame 30, the square pipe (30*a*) is not damaged in spite of the impact of the bullet 8.

After the powder filling materials 301 are filled within the bullet collecting space 300, the front rubber plate 3*a* is installed on the first inclined installation pipes 31. The front rubber pipe 3*a* is installed in a manner of covering the rubber plates with a thickness of 15 mm-25 mm over the powder filling materials 301.

The front rubber plate 3*a* is preferable that the thickness of the rubber plate is differently applied in response to the inclined angle with respect to the bottom surface 5. For example, if the installation angle of the front rubber plate 3*a* is 40-55°, the thickness of the front rubber plate 3*a* is set to 12-20 mm, and if the installation angle of the front rubber plate 3*a* is greater than 55° and not more than 70°, the thickness of the front rubber plate 3*a* is set to 15-22 mm, and if the installation angle of the front rubber plate 3*a* exceeds 70°, the thickness of the front rubber plate 3*a* is preferably set to 17-25 mm. As the inclined angle of the front rubber plate 3*a* is lowered, the distance where the bullet penetrates into the rubber plate is increased. Therefore, it is preferable to set the thickness of the rubber plate to be relatively thin. In contrast, as an inclined angle of the front rubber plate 3*a* is increased, the distance where the bullet penetrates into the rubber plate is reduced. Therefore, it is preferable to set the thickness of the rubber plate to be thick. According to the experiment of the inventors, when the installation angle of the front rubber plate 3*a* is 45°, the thickness of the rubber plate is set to 15 mm. When the installation angle of the front rubber plate 3*a* is 60°, the thickness of the rubber plate 3*a* is set to 17-18 mm. When the installation angle of the rubber plate 3*a* is 80°, the thickness of the rubber plate is preferably set to 20 mm.

Description of Reference Numerals

| | |
|---|---|
| 1: bullet collecting box | 1a: body |
| 2: side plate | 2a: volt |
| 3: upper lid | 3a: handle |
| 4: front rubber plate | 5: support leg |
| 5a: square pipe | 5b: magnet |
| 5c: rubber block | 6: first inner rubber plate |
| 6a: first rubber plate support | |
| 7: second inner rubber plate | |
| 7a: second rubber plate support | 8: bullet |
| 8a: lead component debris | 8b: dust |
| 9: powder filling material | 20: frame |
| 21, 22: plated steel plate | 23: square pipe |
| 40: front bracket | |
| 40a: rubber plate insertion groove | |
| 41: target area | 42: target |
| 43: attachment pin | 44: Bullet passage hole |
| 51: bottom plate | 51a: protruding jaw |
| 52: bottom opening | 53: bottom stopper plate |
| 53a: handle | 53b: sliding groove |
| 71: first air suction duct | 71a: air suction port |
| 71b: first air discharge duct | 71c: induction blower |
| 72: second air suction duct | 72a: air inlet |
| 72b: second air discharge duct | |
| 73: third air discharge duct | |
| 73a: air intake hood | 73b: air induced blower |
| 75: air supply duct | 75a: air supply device |
| 76: air purification device | 77: water treatment device |
| 80: bullet | 81: ammunition |
| 100: bullet collecting system | |
| 101: indoor shooting range | |
| 101a: counterterrorism operational training | |

-continued

| Description of Reference Numerals | |
|---|---|
| shooting range | |
| 101b: inner portion of the shooting range | |
| 102: bottom surface of indoor bullet shooting range | |
| 102a: wall surface | 102b: door |
| 102c: inlet | 102d: outlet |
| 103: slope gradient surface | 104: ceiling |
| 105: drainage trench | 105a: drainage pipe |
| 106: gunner | 106a: firing position |
| 106b: blocking wall | 106c: soldier 107: gun |
| 108: fire detecting sensor | 109: target plate |
| 110: target | 110a: movable target plate |
| 111: target moving system | 111a: number of lane of fire |
| 111b: wheel | 111c: target mounting rod |
| 112: guide rail | 112a: mounting rod |
| 113: guide rail fixing pipe | 116: spray pipe |
| 117: protective case | 120: iron plate beaten zone |
| 121: conventional lower iron plate | |
| 122: conventional upper iron plate | |
| 123b: second empty space | |
| 130, 130a: bullet collecting unit | |
| 131: bullet collecting space | |
| 202,...,208: lanes of fire | 211: first-step |
| 212: two-step | 213: three-step |
| 300: bullet collecting vehicle | 301a: vehicle battery |
| 301b: vehicle wheel | |
| 310: bullet separating and collecting apparatus | |
| 310a: support post | 311: filler collecting barrel |
| 311a: handle | 311c: loading platform |
| 312: bullet storage barrel | 313: vibrating hopper |
| 313a: inclined portion | 313b: hopper outlet |
| 314: separating screen | 314a: screen frame |
| 315: hopper support | 316: buffer spring |
| 316a: upper connecting portion | |
| 316b: lower connecting portion | 317: vibrator |
| 318: power supply device | 318a: wire |
| 319: power switch | 320: fire protection plate |
| 500: water collecting tank | 501: water pump |
| 502: water inlet pipe | 503: water supply pipe |
| 504: electric valve | 505: water supply |
| 506: control unit | 600: LST ship |
| 601, 602: inner space | 605: prow of ship |
| 606: outboard body | 610: land |
| 611: tank | 612: sea |
| 801: carriage portion | 802: jacket |
| 803: core | 804: bullet filling material |
| 805: carriage case | 806: extracted groove |
| 820: beaten zone | |

What is claimed is:

1. A bullet collecting system comprising:

a gun firing position which fires bullets from a gun using a bullet in an indoor shooting range;

a target which is spaced apart by a first distance from the gun firing position;

a bullet collecting unit which is located in a rear side of the target and which collects bullets that are fired by the gun and flying, an internal space of which is filled with rubber powder filling materials having a particle size of 0.1-3 mm;

air suction ducts which are installed in at least two places on a bottom surface of the indoor shooting range between the gun firing position and the bullet collecting unit and which suck gunpowder smokes and dusts including lead fume generated when firing bullets from the gun; and an induction blower which is connected with the air suction ducts, and which can discharge gunpowder smokes and dusts, including the lead fume, outside the indoor shooting range by moving air within the air suction ducts, wherein the bullet collecting unit includes:

a beaten zone structure frame which is fabricated so as to occupy a three dimensional space by combining metal material-made square pipes in a lattice shape, in which a first inclined installation pipes located on the front is installed to be inclined at an angle of 45-90° with respect to the bottom surface of the indoor shooting range;

a pipe protective pad for protecting square pipes without damage when the bullets collide with the square pipes, by wrapping the square pipes forming the beaten zone structure frame;

a second inclined installation pipe which is installed in a lower side of the first inclined installation pipes so as to be inclined at an angle of 20-80° with respect to the bottom surface of the indoor shooting range;

a fire protection plate which is installed to be inclined with respect to the bottom surface by mounting to the second inclined installation pipe;

a front rubber plate which covers the front portion of the beaten zone structure frame and which is supported by the first inclined installation pipes;

a bullet collecting space which is formed by a space between the front rubber plate and the fire protection plate; and a rubber powder filling material filled in the bullet collecting space, whereby the bullet collecting system prevents occurrence of lead fume in the indoor shooting range.

2. The bullet collecting system according to claim 1, wherein the indoor shooting range comprises a beaten zone located at a back side of the target, wherein the beaten zone includes:

a conventional lower iron plate which is configured such that a height of the beaten zone rises toward a back side of the beaten zone while forming an inclination with the bottom surface in a state where a lower end is fixed to the bottom surface of the indoor shooting range; and a conventional upper iron plate which is configured such that the height of the beaten zone lowers toward the back side of the beaten zone while forming an inclination with a ceiling surface in a state where an upper end is fixed to a ceiling of the indoor shooting range, thereby the lower end meets with the upper end of the conventional lower iron plate;

wherein the beaten zone structure frame further includes support columns which are erected and installed on the conventional lower iron plate, and the second inclined installation pipes of the beaten zone structure frame or a pipe structure fabricated by the second inclined installation pipes are installed at a position spaced apart in the upper direction from the conventional lower iron plate via the support columns.

3. The bullet collecting system according to claim 1, wherein the bullet collecting unit comprises:

a spray pipe installed at the upper end of the bullet collecting space;

a protective case which is extended along the longitudinal direction of the spray pipe and wraps around the spray pipe and thus protects the spray pipe so that the spray pipe is not broken by the bullets fired by the gun; and at least one fire detecting sensor which is installed inside the bullet collecting space;

and further comprises:

a water supply pipe of supplying water to the spray pipe;

an electric valve which is installed on the water supply pipe and which serves to send or not send water to the water supply pipe by being open or closed by an electrical signal;

a control unit which is electrically connected with the fire detecting sensor and the electric valve, wherein water is discharged from the spray pipe by sending the opening control signal to the electric valve when the control unit detects that a fire is generated within a bullet collecting space by a signal transmitted from the fire detecting sensor;

a drainage trench installed by digging grooves in the bottom surface in front of the bullet collecting unit;

a water collection tank for collecting water discharged through the drainage trench; and a water pump which is installed inside the water collection tank and sends water in the water collection tank to a water supply pipe.

4. The bullet collecting system according to claim 1, wherein the bullet collecting system further comprises:

one or more guide rails which are connected to a ceiling of the indoor bullet shooting range and installed in parallel with a flying direction of the bullet;

a target moving system which is reciprocally installed along the guide rail; and a target which is mounted downward from the target moving system and which is installed so as to face the front toward the firing position.

5. The bullet collecting system according to claim 1, wherein the square pipes are configured such that the length of one side of a first direction in the cross-sectional structure in the direction perpendicular to the longitudinal direction is 30-120 mm, the length of another side of a second direction perpendicular to the first direction is 30-70 mm, and the thickness of the metal materials constituting the square pipes is 2-10 mm.

6. The bullet collecting system according to claim 1, wherein the pipe protective pad comprises:

a first protective pad which is installed to extend along the length direction of the square pipe while wrapping at least three sides of the square pipe;

a second protective pad which is detachably combined via a Velcro tape to the upper surface of the first protective pad;

a first Velcro tape which is adhesively combined to the top surface of the first protective pad; and a second Velcro tape which is adhesively combined to the lower surface of the second protective pad, wherein the first protective pad is fixed to the square pipe by securing a bolt to the square pipe, when based on the first surface of the square pipe toward the flying direction of bullets, the thickness from one surface of the first protective pad in contact with the first surface to the opposite side is 40-120 mm, when based on the second surface of the square pipe toward the direction different from the flying direction of bullets, the thickness from one surface of the first protective pad in contact with the second surface to the opposite side is 30-720 mm, and the thickness of the second protective pad is 30-70 mm.

7. The bullet collecting system according to claim 5, wherein the pipe protective pad comprises:

a first protective pad which is installed to extend along the length direction of the square pipe while wrapping at least three sides of the square pipe;

a second protective pad which is detachably combined via a Velcro tape to the upper surface of the first protective pad;

a first Velcro tape which is adhesively combined to the top surface of the first protective pad; and a second Velcro tape which is adhesively combined to the lower surface of the second protective pad, wherein the first protective pad is fixed to the square pipe by securing a bolt to the square pipe, when based on the first surface of the square pipe toward the flying direction of bullets, the thickness from one surface of the first protective pad in contact with the first surface to the opposite side is 40-120 mm, when based on the second surface of the square pipe toward the direction different from the flying direction of bullets, the thickness from one surface of the first protective pad in contact with the second surface to the opposite side is 30-720 mm, and the thickness of the second protective pad is 30-70 mm.

8. The bullet collecting system for according to claim 1, wherein the pipe protective pad includes:

a first protective pad which is installed to extend along the length direction of the square pipe while being in contact with the first surface of the square pipe toward the flying direction of bullets;

a side protective pad which is installed to extend along the length direction of the square pipe while being in contact with the side surface extending after bending from the first surface of the square pipe;

a second protective pad which is detachably combined via a Velcro tape to the upper surface of the first protective pad;

a first Velcro tape which is adhesively combined to the top surface of the first protective pad; and a second Velcro tape which is adhesively combined with the lower surface of the second protective pad, wherein the first protective pad is fixed to the square pipe by securing a bolt to the first surface of the square pipe, the second protective pad is fixed to the square pipe by securing a bolt to the side surface of the square pipe, the thickness of the first protective pad is 40-120 mm, the thickness of the side protective pad is 30-70 mm, and the thickness of the second protective pad is 30-70 mm.

9. The bullet collecting system according to claim 5, wherein the pipe protective pad includes:

a first protective pad which is installed to extend along the length direction of the square pipe while being in contact with the first surface of the square pipe toward the flying direction of bullets;

a side protective pad which is installed to extend along the length direction of the square pipe while being in contact with the side surface extending after bending from the first surface of the square pipe;

a second protective pad which is detachably combined via a Velcro tape to the upper surface of the first protective pad;

a first Velcro tape which is adhesively combined to the top surface of the first protective pad; and a second Velcro tape which is adhesively combined with the lower surface of the second protective pad, wherein the first protective pad is fixed to the square pipe by securing a bolt to the first surface of the square pipe, the second protective pad is fixed to the square pipe by securing a bolt to the side surface of the square pipe, the thickness of the first protective pad is 40-120 mm, the thickness of the side protective pad is 30-70 mm, and the thickness of the second protective pad is 30-70 mm.

10. The bullet collecting system according to claim 1, wherein the rubber powder filling materials include one or more materials selected from the group consisting of a rubber, a synthetic rubber, a natural rubber, a pulverized material of waste tire, and a silicon rubber material.

11. The bullet collecting system according to claim 1, wherein a powder fire-extinguishing agent components are mixed within the rubber powder filling materials, and the weight of the powder fire-extinguishing agent mixed is 2-10% of the total weight of the rubber powder filling material.

12. The bullet collecting system according to claim 10, wherein powder fire-extinguishing agent components are mixed within the rubber powder filling materials, and the weight of the powder fire-extinguishing agent mixed is 2-10% of the total weight of the rubber powder filling material.

13. The bullet collecting system according to claim 1, wherein, when the front rubber plate has an inclined angle of 40-55° with respect to the bottom surface of the indoor shooting range, the thickness of the front rubber plate is set to 12-20 mm; when the front rubber plate has an inclined angle of greater than 55° and less than 70° relative to the bottom surface, the thickness of the front rubber plate is set to 15-22 mm; and when the front rubber plate has an inclined angle of greater than 70° relative to the bottom surface, the thickness of the front rubber plate is set to 17-25 mm.

14. The bullet collecting system according to claim 1, wherein the bullet collecting unit is divided into a plurality of lanes of fire, and also divided into the beaten zones of greater than 2 steps and less than 4 steps depending on the height direction, one beaten zone defined by one step in one lane of fire when viewing the bullet collecting unit from the gun firing position has a width of 1.3-1.6 m and a height of 1.0-1.4 m.

15. The bullet collecting system according to claim 14, wherein the one beaten zone can be divided into m×n number of sub-zones, where n and m are 2 to 3, the target is positioned in one of the sub-zones within the one beaten zone, but movably located while alternating the sub-zones, thereby inducing that a place where the bullets are collected in a area of the front portion of one bullet collecting box is uniformly distributed.

16. The bullet collecting system according to claim 1, wherein the bullet collecting unit further includes:

a plurality of horizontal installation pipes which connect the first inclined installation pipes of the beaten zone structure frame and the second inclined installation pipes corresponding thereto in to the horizontal direction, respectively; and an upper and lower partition plate which is installed to mount on the horizontal installation pipes, the bullet collecting space of the bullet collecting unit is divided into a space at a upper step and a space at a lower step by the upper and lower partition plate, and powder filling materials filled within the space at the upper step is restricted from being moved into a space at the lower step.

17. A bullet collecting system comprising an indoor shooting range provided in an inner space of a warship including LST (landing ship tank) ship and a ship for landing operations, wherein the indoor shooting range includes:

a gun firing position which fires bullets from a gun using a bullet in the indoor shooting range;

a target which is spaced apart by a first distance from the gun firing position;

a bullet collecting unit which is located in a rear side of the target and which collects bullets that are fired by the gun and flying, an internal space of which is filled with rubber powder filling materials having a particle size of 0.1-3 mm;

air suction ducts which are installed in at least two places on the bottom surface of the indoor shooting range between the gun firing position and the bullet collecting unit and which suck gunpowder smokes and dusts including lead fume generated when firing bullets from the gun; and an induction blower which is connected with the air suction ducts, and which can discharge gunpowder smokes and dusts, including the lead fume, outside the indoor shooting range by moving air within the air suction ducts, wherein the bullet collecting unit includes:

a beaten zone structure frame which is fabricated so as to occupy a three dimensional space by combining metal material-made square pipes in a lattice shape, in which first inclined installation pipes located on the front is installed to be inclined at an angle of 45-90° relative to the bottom surface of the indoor shooting range;

a pipe protective pad for protecting square pipes without damage when the bullets collide with the square pipes by wrapping the square pipes forming the beaten zone structure frame;

a second inclined installation pipe which is installed in the lower side of the first inclined installation pipes so as to be inclined at an angle of 20-80° with respect to the bottom surface of the indoor shooting range;

a fire protection plate which is installed to be inclined with respect to the bottom surface by mounting to the second inclined installation pipe;

a front rubber plate which covers the front portion of the beaten zone structure frame and which is supported by the first inclined installation pipes;

a bullet collecting space which is formed by a space between the front rubber plate and the fire protection plate; and a rubber powder filling material filled in the bullet collecting space.

* * * * *